US009302753B2

(12) United States Patent
Montousse

(10) Patent No.: US 9,302,753 B2
(45) Date of Patent: Apr. 5, 2016

(54) UNDERWATER PERSONAL MOBILITY DEVICE WITH ON-BOARD OXYGEN

(71) Applicant: Julien Montousse, Los Angeles, CA (US)

(72) Inventor: Julien Montousse, Los Angeles, CA (US)

( * ) Notice: Subject to any disclaimer, the term of this patent is extended or adjusted under 35 U.S.C. 154(b) by 0 days.

(21) Appl. No.: 14/150,594

(22) Filed: Jan. 8, 2014

(65) Prior Publication Data

US 2014/0190389 A1 Jul. 10, 2014

Related U.S. Application Data

(60) Provisional application No. 61/751,071, filed on Jan. 10, 2013.

(51) Int. Cl.
*B63C 11/46* (2006.01)
*B63C 11/22* (2006.01)

(52) U.S. Cl.
CPC ..... *B63C 11/46* (2013.01); *B63C 11/22* (2013.01)

(58) Field of Classification Search
CPC ..... B63C 11/18; B63C 11/44; B63C 11/46
USPC ..... 114/312, 313, 315
See application file for complete search history.

(56) References Cited

U.S. PATENT DOCUMENTS

| | | | | |
|---|---|---|---|---|
| 3,204,596 | A | 9/1965 | Fallon | |
| 5,433,164 | A | 7/1995 | Sneath | |
| 5,988,096 | A | 11/1999 | Benesch et al. | |
| 6,443,087 | B1 | 9/2002 | Stecker, Sr. | |
| 6,575,114 | B2 | 6/2003 | Sandler et al. | |
| 6,606,960 | B1 | 8/2003 | Leibolt et al. | |
| 6,941,883 | B2 | 9/2005 | Nguyen | |
| 6,990,919 | B1 | 1/2006 | Calinawan | |
| 7,004,099 | B2 | 2/2006 | Lijima et al. | |
| 7,353,767 | B2 | 4/2008 | Taelman | |
| 8,869,729 | B2 * | 10/2014 | Montousse | 114/313 |
| 2009/0000617 | A1 | 1/2009 | Rosenberger | |

FOREIGN PATENT DOCUMENTS

| | | | |
|---|---|---|---|
| AU | 671 664 | B2 | 9/1996 |
| FR | 2881105 | | 7/2006 |
| FR | 2914196 | A1 | 10/2008 |
| WO | WO 01/76935 | A1 | 10/2001 |
| WO | WO 2006/015438 | A1 | 2/2006 |

OTHER PUBLICATIONS

International Search Report re International Application No. PCT/US2014/010751 dated Apr. 28, 2014, in 10 pages.
Written Opinion re International Application No. PCT/US2014/010751; Mailing Date: Dec. 8, 2014; 7 pages.
International Search Report; PCT/US2012/044725; Mailing Date: Nov. 20, 2012; 9 pages.
Office Action dated Nov. 8, 2013 corresponding to U.S. Appl. No. 13/533,541, in 9 pages.

* cited by examiner

*Primary Examiner* — Lars A Olson
(74) *Attorney, Agent, or Firm* — Knobbe Martens Olson & Bear LLP

(57) ABSTRACT

An underwater personal mobility device is provided. The underwater personal mobility device can include a lower section rotatably connected to a main body comprised of an observation chamber. The device may have at least two configurations, including a folded configuration, to enable ease of transport and storage of the device.

25 Claims, 22 Drawing Sheets

UNDERWATER PERSONAL MOBILITY DEVICE WITH ON-BOARD OXYGEN

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

This application claims the benefit of U.S. Provisional Application No. 61/751,071, entitled "UNDERWATER PERSONAL MOBILITY DEVICE," filed Jan. 10, 2013, the entirety of which is incorporated herein by reference.

FIELD OF THE INVENTION

The invention relates generally to submersible personal mobility devices.

DESCRIPTION OF THE RELATED ART

Protective coverings for persons during underwater activities are generally well known. Such previously known protective coverings may be made of water resistant, semi-rigid materials and have viewing facilities. Other known submersible devices comprise a sealed chamber which may house one or more persons. In such devices, a user enters the chamber via a hatch and has a supply of air onboard the submersible device.

SUMMARY OF THE INVENTION

One aspect of at least one embodiment of the invention is the recognition that it would be desirable to have a protective covering for underwater activities that would not require that a user be equipped with full diving equipment in order to be able to breathe underwater. Likewise, it would be desirable that such a covering not require specialized training, such as diving certifications. One embodiment of an underwater personal mobility device is disclosed in U.S. patent application Ser. No. 13/533,541, filed Jun. 26, 2012, which is hereby incorporated by reference in its entirety.

Another aspect of at least one embodiment of the present invention is the recognition that it would be desirable not to have the user enter a sealed chamber via a hatch since use of such devices is generally limited by the amount of breathable air carried onboard the submersible device.

Yet another inventive aspect of at least one embodiment of the present invention is the recognition that a personal submersible device that allows a user to operate the unit without requiring the user to wear full diving equipment or necessitating a tether to the surface would have many benefits. These benefits would include increased flexibility and autonomy of use, as such a device could be used by a greater number of people, including tourists or scientists, without requiring extensive training or equipment. Further benefits would include ease of use due to a natural steering interface and user position. The personal submersible device could also be easier to manipulate and transport, particularly if the device were able to fold for transportation and storage.

In addition to user-related advantages, another inventive aspect of at least one embodiment of the invention is the recognition that it would be desirable to provide a submersible personal mobility device which provides an ecological advantage through the use of renewable energy sources. These sources may be used to provide power to various components of the unit and may comprise solar panels installed on the device to provide solar-generated electrical power to be used, for example, by an electrical air pump or electric motor.

Yet another inventive aspect of at least one embodiment of the present invention is the use of a multidisciplinary ocean data collector sensor located on or within the submersible personal mobility device. Through this data collection sensor, the submersible is desirably able to collect ocean data, such as but not limited to water temperature, water depth, and pollution levels at any time while the submersible is in use in the water.

Additionally, in yet another aspect of at least one embodiment of the present invention, the submersible personal mobility device can allow a user to monitor offshore subaquatic sites and materials, such as oil drilling facilities, at depths up to and including 150 feet.

Yet another inventive aspect of at least one embodiment of the present invention is the recognition that an apparatus that can unfold on its own when dropped in the water and stay upright would increase the ease of the use of the apparatus. When the device unfolds on its own in the water, the device forms a space for a user to get at least his or her head and shoulders into an observation chamber filled with breathable air. Thus, the user does not need to use a regulator or a strapped-on oxygen tank to breathe while underwater.

In some embodiments, including the illustrated embodiment, an underwater personal mobility apparatus is disclosed. In some aspects, an underwater personal mobility apparatus may include a main body including a main section and a folding section further including a mount for an oxygen tank, wherein the folding section is rotatable with respect to the main section such that the apparatus may be folded to a folded configuration to facilitate transportation of the apparatus and may be unfolded when submerged to an unfolded configuration, said underwater personal mobility apparatus further including a propulsion mechanism. The propulsion mechanism may be supported by the main section. The propulsion mechanism may be operatively connected to one of the main section and a rear section coupled to the main section. In some aspects, the propulsion mechanism further includes an electrically powered motor, a thruster driven by the motor, and at least one battery connected to the motor. In some aspects, the mount defines a cylindrical surface for at least partially supporting an oxygen tank. In some aspects, the mount is positioned such that a center of gravity of an oxygen tank is secured by the mount in front of the observation chamber when the apparatus is in an unfolded configuration.

In some aspects, the folding section is rotatably connected to the main section via a mechanical linkage. In some aspects, the folding section rotates about a linkage axis defined by the mechanical linkage. In some aspects, the folding section further includes an oxygen tank storage space configured to receive an oxygen tank such that the oxygen tank cannot be removed from the oxygen tank storage space when the apparatus is in an unfolded configuration and the oxygen tank may be removed from or placed within the oxygen tank storage space when the apparatus is in a folded configuration.

In some aspects, the main section further includes a buoyancy chamber. In some aspects, the buoyancy chamber is located above the linkage axis. In some aspects, the buoyancy chamber is located such that the buoyancy chamber is above the folding section when the apparatus is in an unfolded configuration. In some aspects, the apparatus is steerable with a lower portion of a body of a user. In some aspects, the underwater personal mobility apparatus further includes a rear section that is rotatable with respect to the main section. In some aspects, the rear section further includes the propulsion mechanism and at least a portion defining a steering surface configured to contact at least a portion of a user's lower body such that the user can steer the underwater personal mobility apparatus by turning the user's body to engage the steering surface.

In some aspects, the underwater personal mobility apparatus further includes an observation chamber for retaining at least a head of a user. In some aspects, the observation chamber comprises part of the main section. In some aspects, the underwater personal mobility apparatus further includes hand controls located forward and below the observation chamber. In some aspects, the underwater personal mobility apparatus may be configured to define an open space for the user's hips and buttocks configured such that the user's hips and buttocks are located below and behind the observation chamber when the user's head is within the observation chamber. In some aspects, the open space is configured such that a user's legs and feet may extend below and behind the user's hips and buttocks.

In some aspects, the underwater personal mobility apparatus further includes at least one wheel such that when the underwater personal mobility apparatus is in a folded configuration and the wheel is on a rolling surface, a center of gravity of an oxygen tank is forward of the wheel to make the underwater personal mobility apparatus easy to rotate about the wheel. In some aspects, the underwater personal mobility apparatus further includes a deployable buoy that can deploy from the main section. In some aspects, the buoyancy chamber, deployable buoy, propulsion mechanism, and oxygen tank storage space are located around the user when the user's head is within the observation chamber that the underwater apparatus may achieve neutral buoyancy and vertical stability at a predetermined depth.

In another aspect, an underwater personal mobility apparatus includes a main body including a main section, a folding section, and a rear section, the main section supporting at least one buoyancy member and an observation chamber, the observation chamber configured to accommodate at least a user's head, the folding section configured to hold an oxygen tank, the folding section rotatable with respect to the main section such that the apparatus may fold for ease of use, the rear section including a propulsion mechanism, the rear section rotatable with respect to the main section and configured to contact the user's body such that a user's hips can rotate the rear section to steer the underwater personal mobility apparatus. In some aspects, the underwater personal mobility apparatus may further include at least one wheel located on a lower portion of the folding section such that a center of gravity of the oxygen tank is located forward of the at least one wheel when the apparatus is in a folded configuration.

In yet another aspect, an underwater personal mobility apparatus includes a main body including a main section and a folding section, the main section including a buoyancy chamber. The folding section may be rotatable with respect to the main section such that the apparatus may be folded to a folded configuration to facilitate transportation of the apparatus and may be unfolded when submerged to an unfolded configuration, said underwater personal mobility apparatus further including a propulsion mechanism.

In another aspect, an underwater personal mobility apparatus includes a main body including a main section and a folding section further including a mount for an oxygen tank. The folding section may be rotatable with respect to the main section such that the apparatus may be folded to a folded configuration to facilitate transportation of the apparatus and may be unfolded when submerged to an unfolded configuration, said underwater personal mobility apparatus further including a propulsion mechanism and said underwater personal mobility apparatus is steerable with a lower portion of a body of a user.

In yet another aspect, an underwater personal mobility apparatus includes a main body including a main section, the main section including a buoyancy chamber. The underwater personal mobility apparatus may be steerable with a lower portion of a body of a user and said underwater personal mobility apparatus further includes a propulsion mechanism.

All of these embodiments are intended to be within the scope of the inventions herein disclosed. These and other embodiments of the present invention will become readily apparent to those skilled in the art from the following detailed description of the preferred embodiments having reference to the attached figures, the invention not being limited to any particular preferred embodiment(s) disclosed.

BRIEF DESCRIPTION OF THE DRAWINGS

These and other features, aspects, and advantages of the present invention will now be described in connection with preferred embodiments of the present invention, in reference to the accompanying drawings. The illustrated embodiments, however, are merely examples and are not intended to limit the invention.

DETAILED DESCRIPTION OF THE PREFERRED EMBODIMENT

Figure 1A:
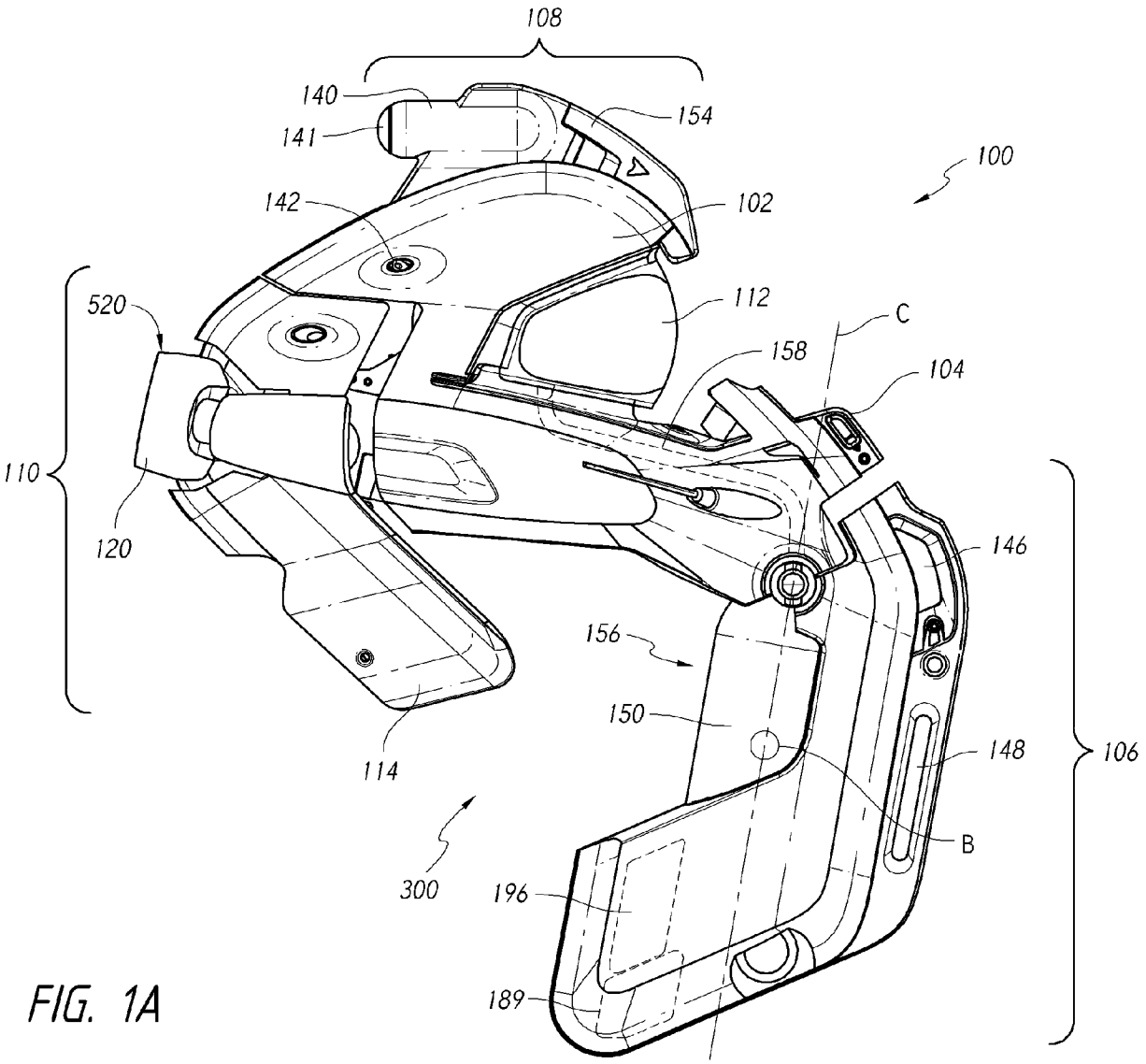
FIG. 1A is a right side view of an underwater personal mobility device according to a preferred embodiment of the invention.

The following detailed description is directed to certain specific embodiments of the invention. However, the invention may be embodied in a multitude of different ways as defined and covered by the claims.

One embodiment of a personal submersible device capable of transporting a human being under water is depicted in FIGS. 1-19. The personal submersible device 100 comprises a main section 102 which may be supported, either directly or indirectly, by a chassis 104. Other embodiments may not include the chassis 104. In the illustrated embodiment, the personal underwater device 100 further comprises a lower section 106, an upper section 108, and a rear section 110, as shown most clearly in FIG. 1B. The lower section 106 and the rear section 110 may rotate with respect to the main section 102 as will be discussed in detail below. In some embodiments, a propulsion mechanism 120 may be supported by the main section 102.

To facilitate understanding of the invention, the illustrated embodiments are described in the context of an orientation system based on a user 144 facing forward as shown, for example, in FIGS. 4-7A. Thus, the right side of the device corresponds to the user's right side, the left side of the device corresponds to the user's left side, and the front of the device corresponds to the front of the user's face when the user is facing directly forward with the chin extended horizontally. Note, in FIGS. 4-7A, the user is facing downward approximately 35-45 degrees from directly forward, which provides a comfortable viewing angle for the user while operating the submersible device. When vertically upright in the water, the upper section 108 is the top or highest point of the device and the lowest portion of the lower section 106 is the bottom or lowest point of the device. In a vertically upright position in the water, the lower section 106 is at a lower depth within the water than the upper section 108.

Figure 1B:
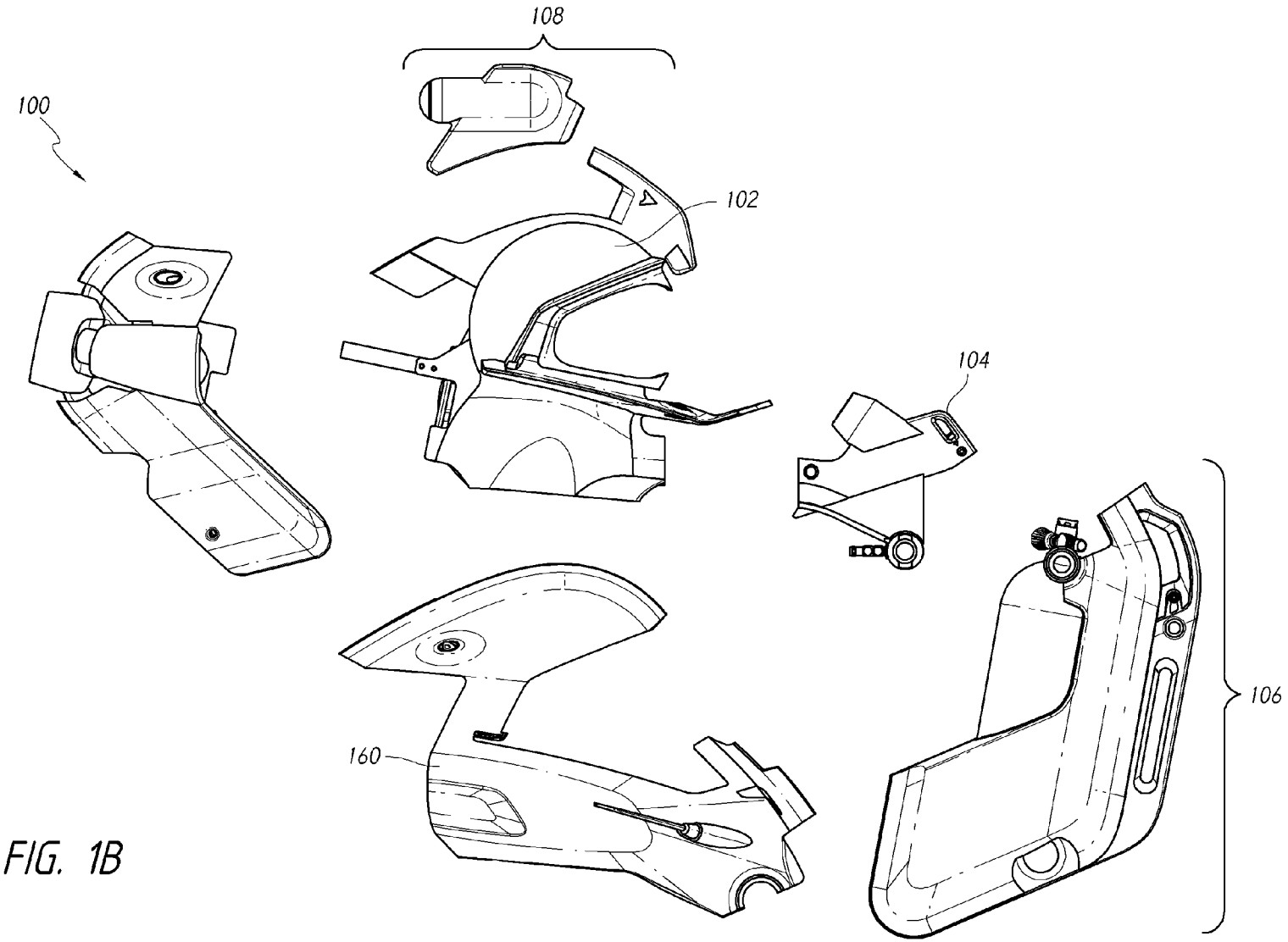
FIG. 1B is a partially exploded view of an underwater personal mobility device.
Figure 2:
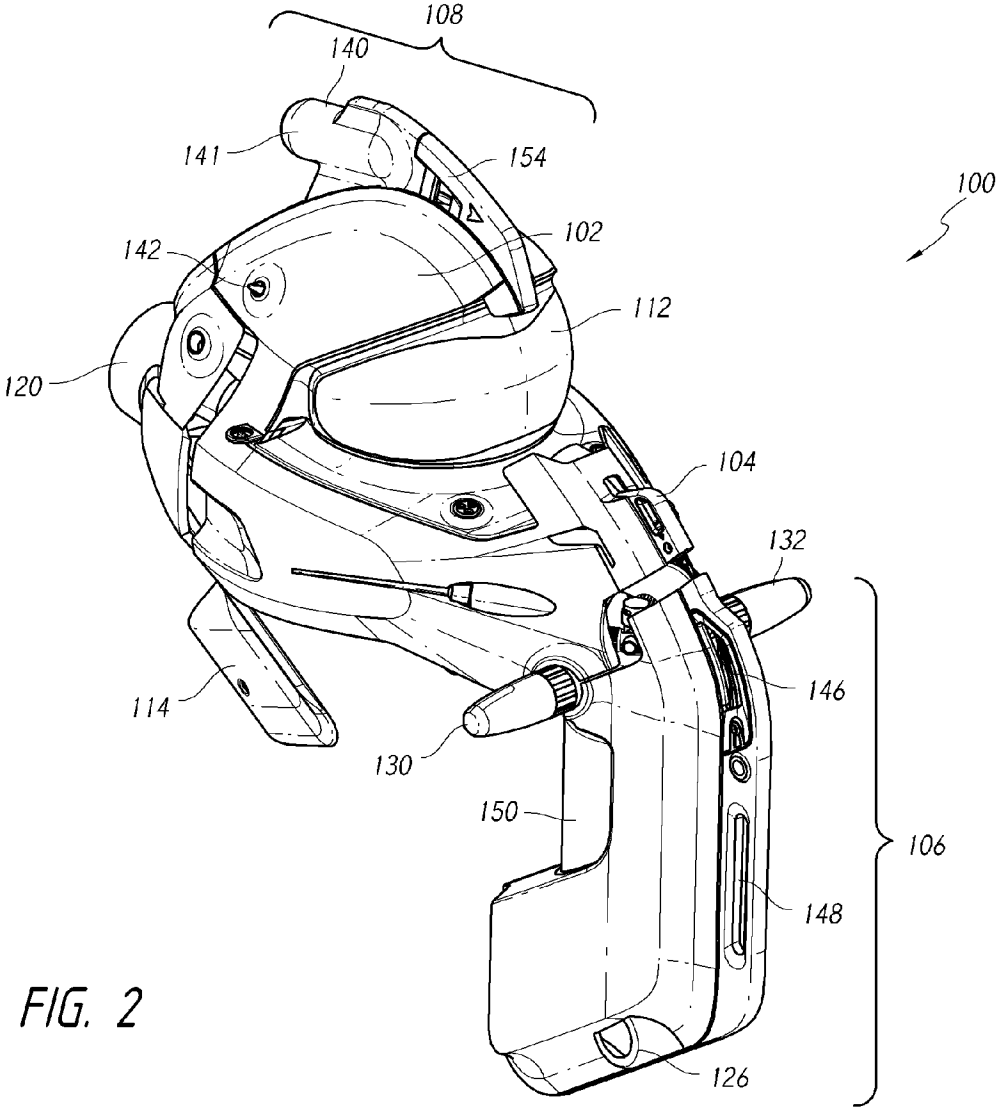
FIG. 2 is a perspective front right view of an underwater personal mobility device.
Figure 3:
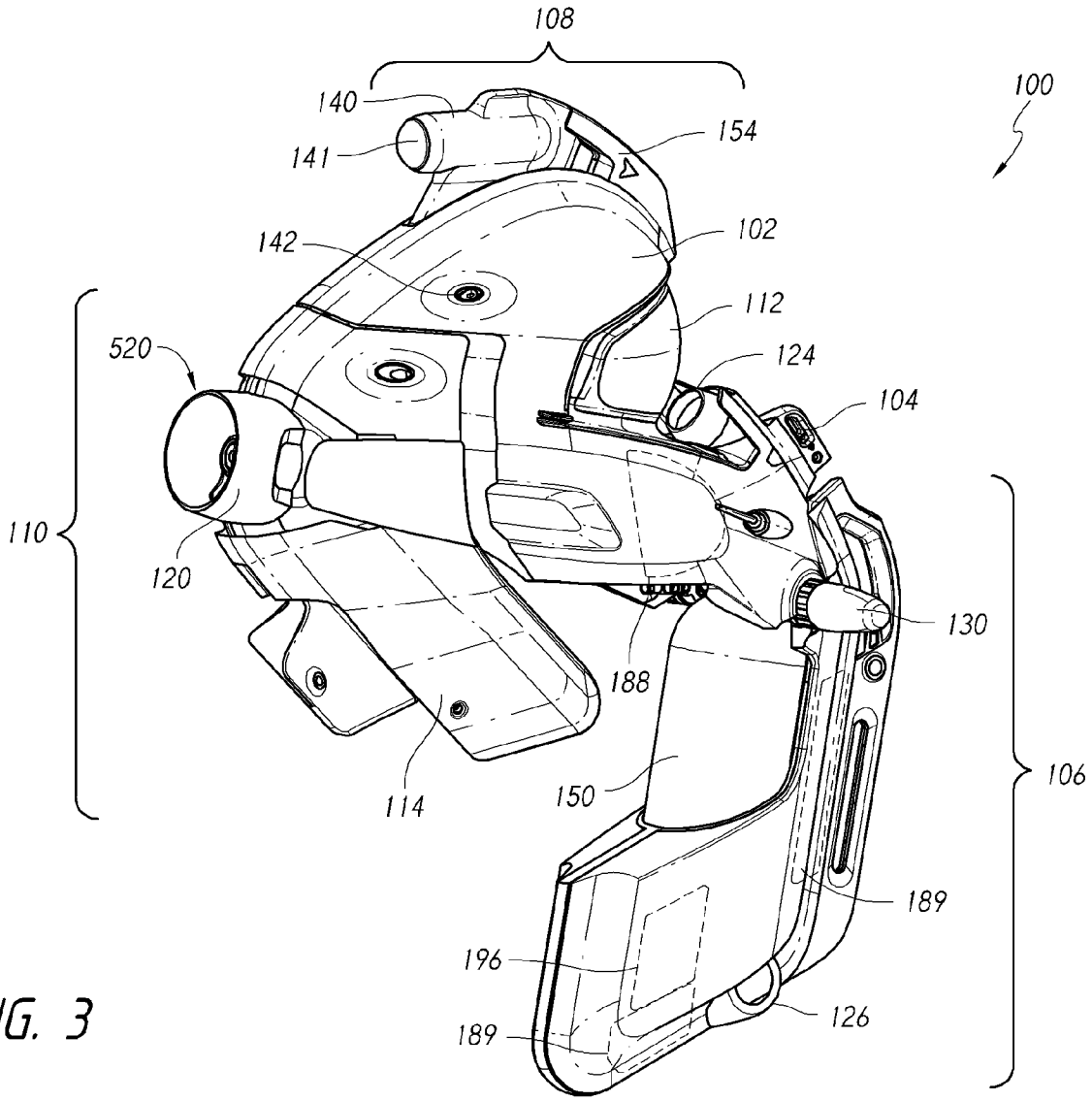
FIG. 3 is a perspective rear right view of an underwater personal mobility device.
Figure 4:
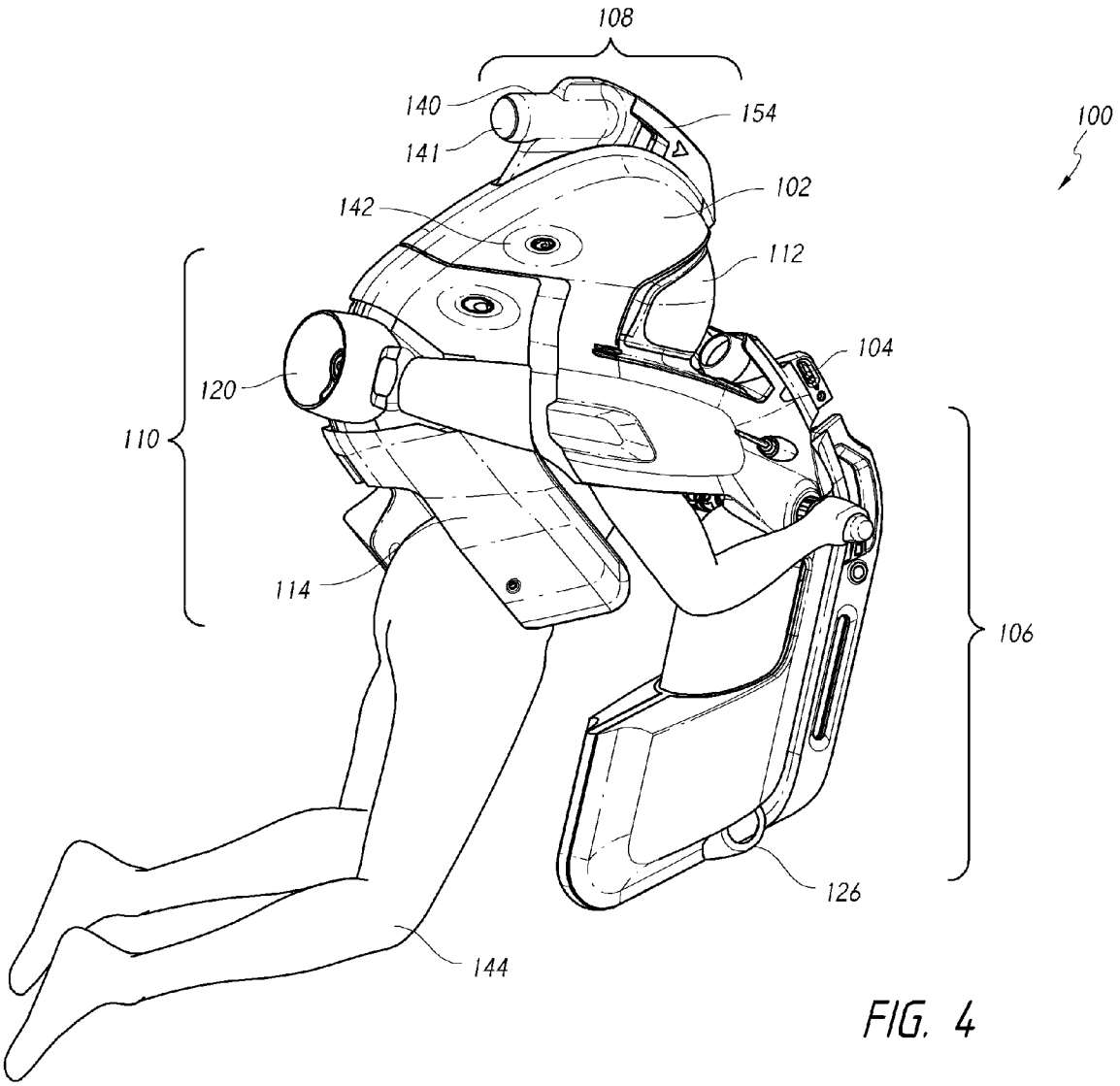
FIG. 4 is a second perspective right rear view of an underwater personal mobility device and a user thereof.
Figure 5:
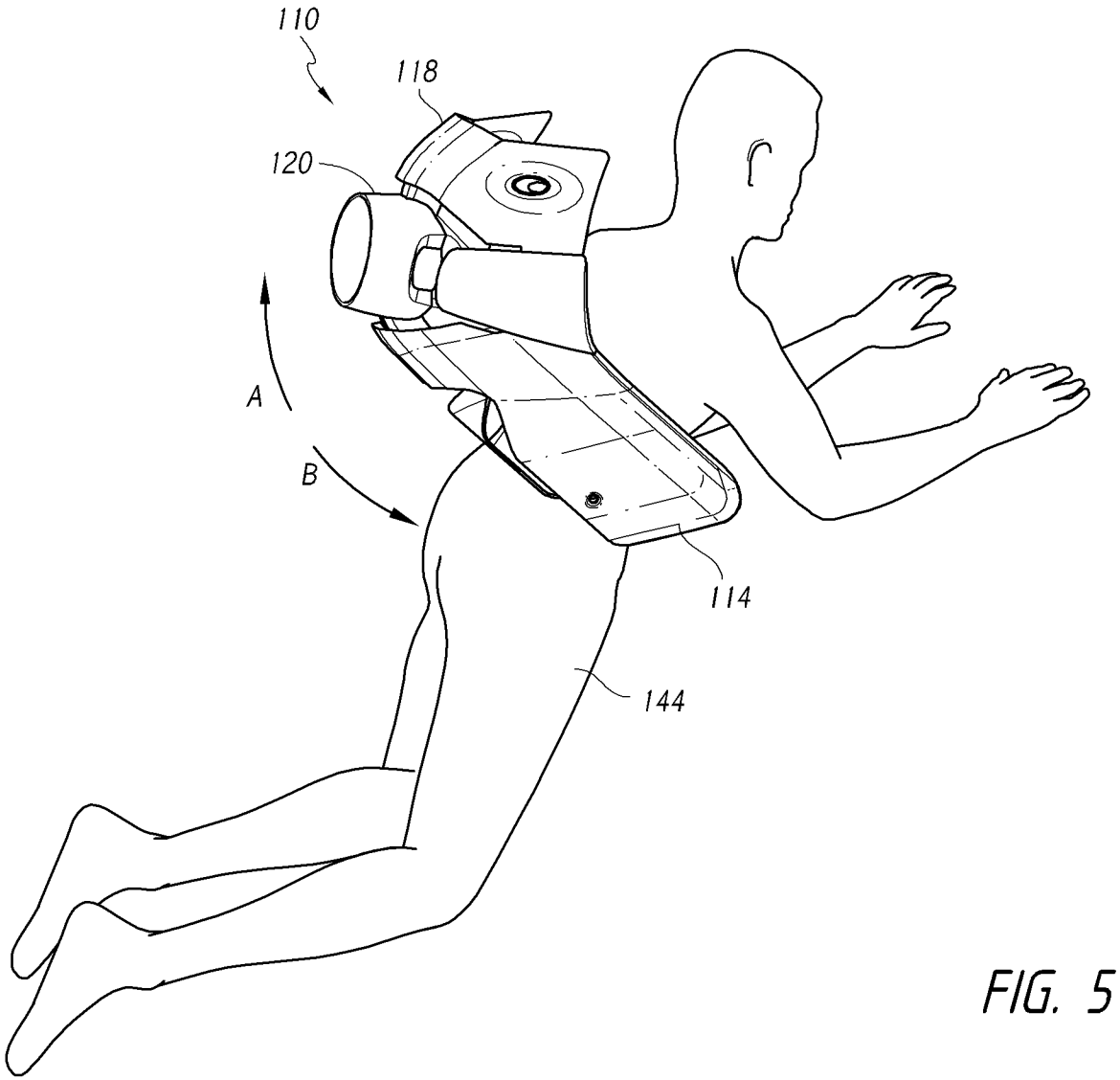
FIG. 5 is a perspective rear right view of a rear section of an underwater personal mobility device and a user thereof.

FIGS. 1-4 depict a preferred embodiment having certain features, aspects, and advantages of the present invention. FIGS. 1-3 depict views of the right side of a preferred embodiment of a personal underwater mobility device. FIG. 4 depicts the same embodiment as that shown in FIGS. 1-3 but also includes a user 144 interacting with the device 100. Personal underwater mobility device 100 may include more, fewer, or different components than those shown in FIGS. 1-4.

The personal underwater mobility device 100 may include the chassis 104 that may directly or indirectly support an observation chamber 112 and the lower section 106. The observation chamber 112 is desirably an open chamber that desirably accommodates the user's head and shoulders. Advantageously, when the user 144 places his or her head and shoulders within the observation chamber 112, as shown in FIG. 4, the user's head and shoulders remain dry. Furthermore, the observation chamber 112 desirably is of a size and shape such that it provides the additional advantage of allowing the user 144 greater freedom of movement to view the surrounding environment by turning his or her head from side to side within the observation chamber 112. Additionally, the observation chamber 112 desirably provides a comfortable chamber from which to view the underwater environment without the discomfort of needing to hold a breathing device in the mouth.

Chassis 104 may further comprise an instrument section 124 oriented to face the user 144 when the user's head and shoulders are within the observation chamber 112, as shown in FIGS. 3 and 4. The instrument section 124 may include gauges for indicating statistics related to the use of the device 100, including but not limited to the amount of oxygen remaining, current depth, maximum depth, current time, water temperature, speed, duration of the current dive, GPS coordinates, etc. In some embodiments, an instrument display 198 is projected onto an interior surface of the viewing portion 190 similar to a heads-up display, as shown from outside the observation chamber 112 in FIG. 2. Projection of the instrument display 198 on the interior surface of the viewing portion 190 allows the user 144 to view statistics related to operation of the submersible 100 without requiring the user 144 to look away from the external environment. The user 144 can therefore remain focused on objects outside the submersible 100 without having to look away from the viewing portion 190.

Figure 8:
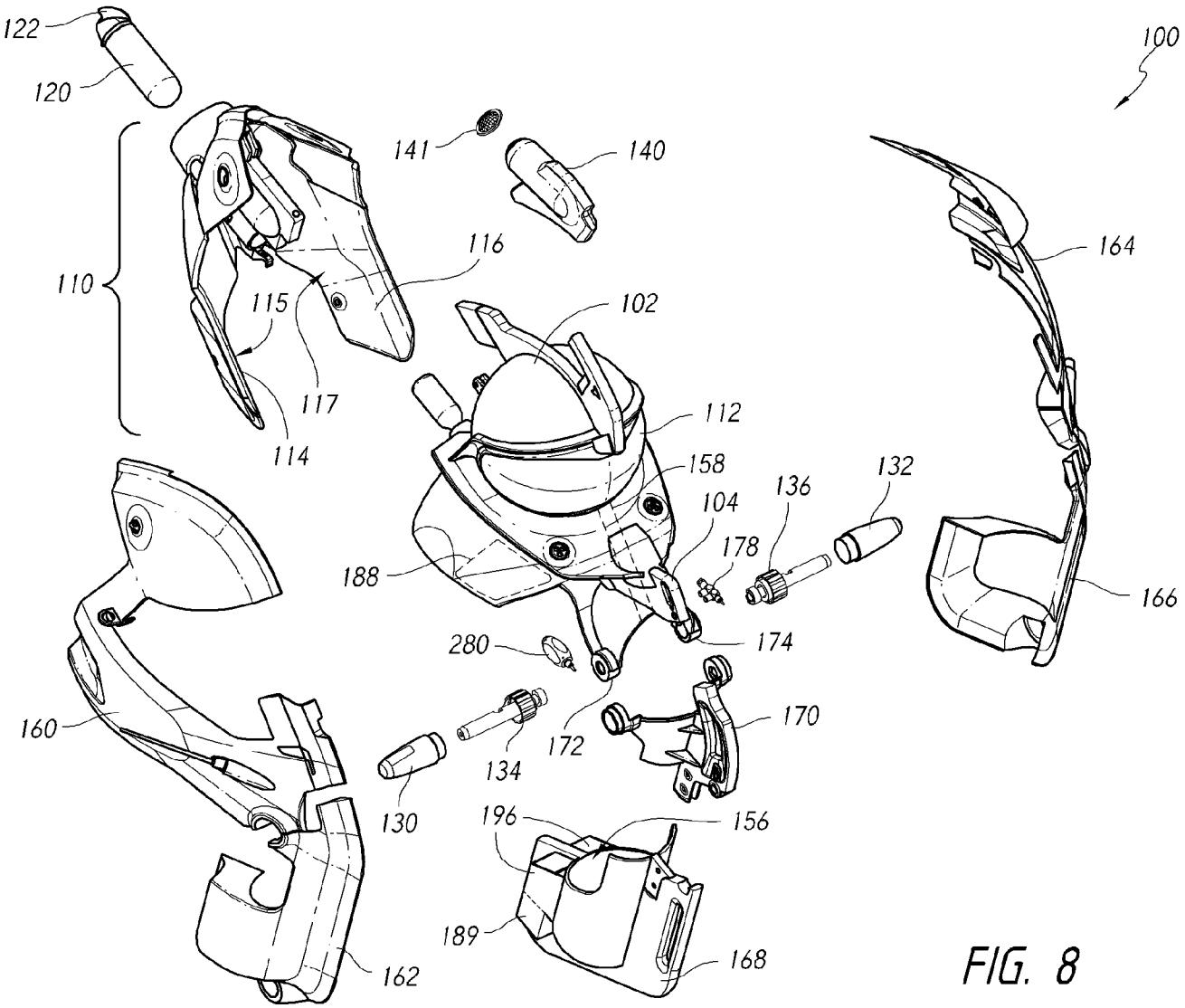
FIG. 8 is perspective right front view of an exploded assembly of an underwater personal mobility device according to a preferred embodiment of the invention.
Figure 9:
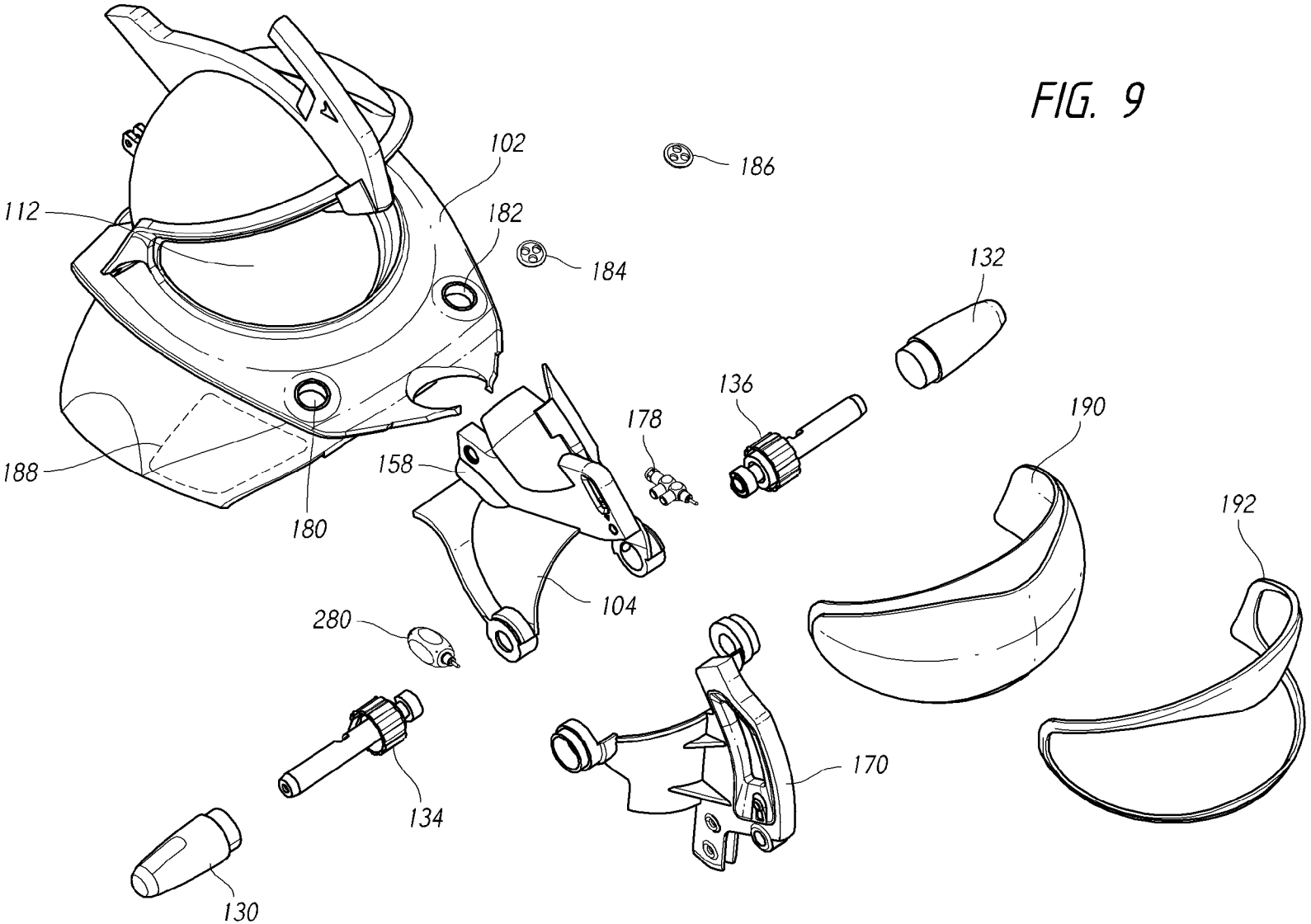
FIG. 9 is perspective right front view of an exploded partial assembly of an underwater personal mobility device according to a preferred embodiment of the invention.

The chassis 104 may also include user graspable handles 130, 132. One handle 130 is located on the right side of the device 100, as shown in FIGS. 1-4, while a second handle 132 is located on the left side of the device 100 (as shown in FIGS. 8 and 9). The handles 130, 132 allow the user 144 to orient his or her body for stability while using the device 100. The handles 130, 132 may further allow the user to control the depth and speed of the device 100 by varying the amount of air in buoyancy bags located on the device 100 or increasing or decreasing the speed of the propulsion mechanism 120, as will be discussed in further detail below. For example, the user graspable handle 130 may be used to control the speed of the device 100 and the on/off status of the propulsion mechanism while user graspable handle 132 may be used to control the depth of the personal underwater mobility device 100 by controlling the buoyancy of the device. In other embodiments, the user graspable handle 130 may be used to control the depth of the personal underwater mobility device 100 by controlling the buoyancy of the device while the user graspable handle 132 may be used to control the speed and on/off status of the device 100. It will be appreciated that the controls may be reversed, if desirable.

In addition to providing stability for the user 144 while operating the device 100, in some embodiments, one of the handles 130, 132 may provide a means for controlling the propulsion mechanism 120 of the device 100 or the direction of travel via a rudder, fins, or other means.

Figure 17:
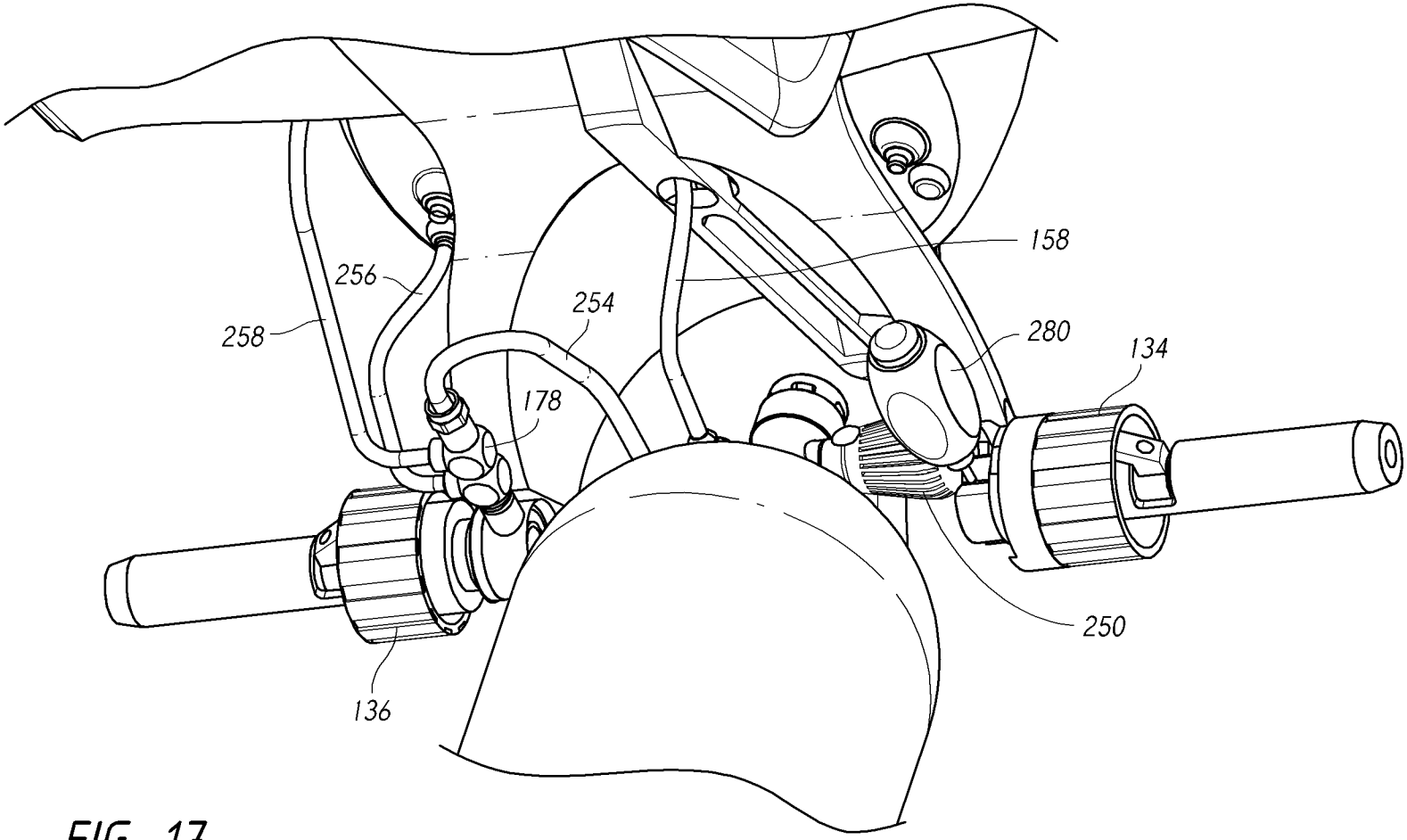
FIG. 17 is a view of the underside of a chassis of an underwater personal mobility device, illustrating an oxygen tank and oxygen connections.
Figure 18:
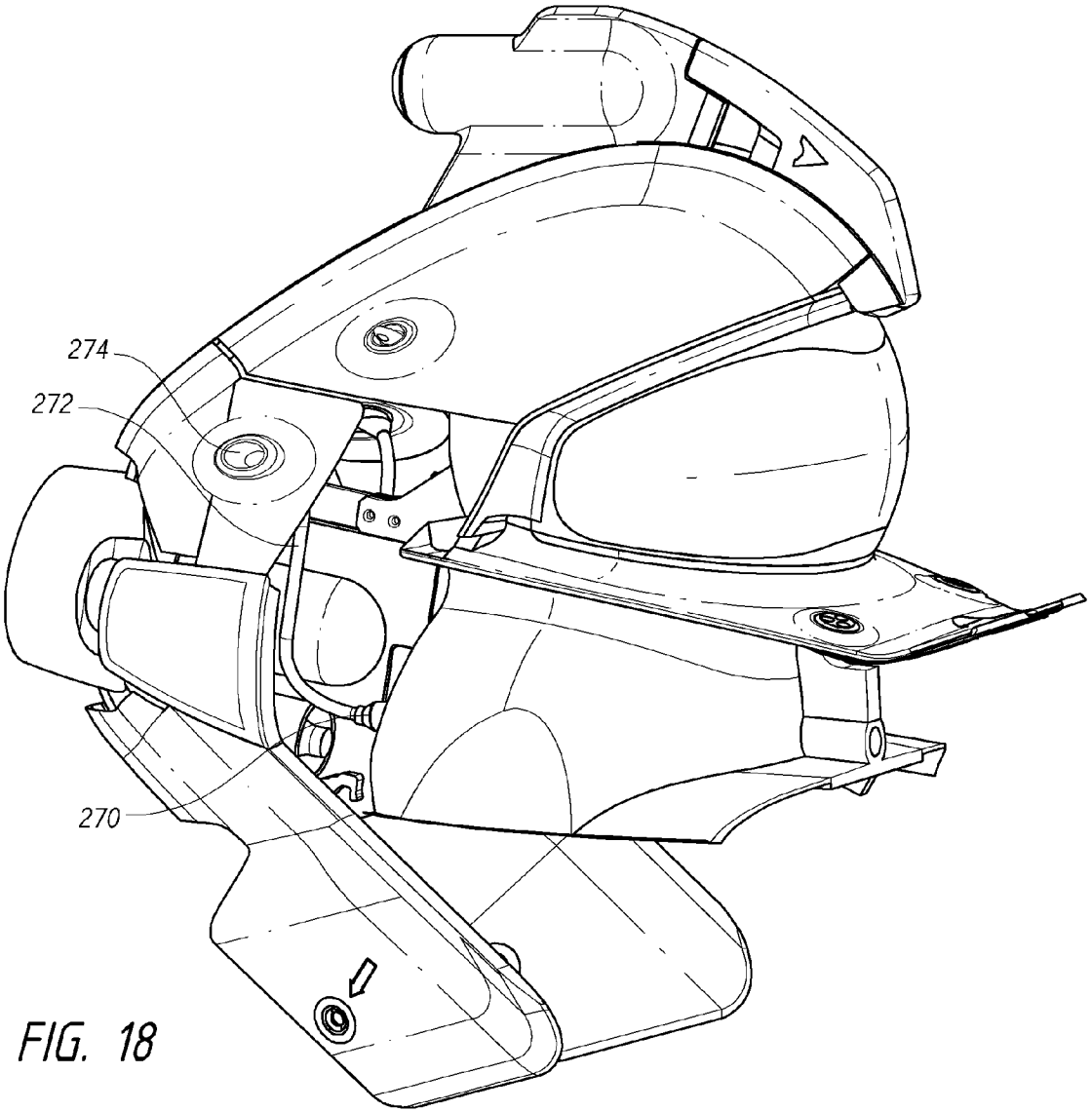
FIG. 18 is a partial right side view of an underwater personal mobility device illustrating the conduit allowing exhaled carbon dioxide to exit an observation chamber 112 of the underwater personal mobility device.

The chassis 104 may further include a central oxygen conduit 158 to conduct oxygen from an oxygen tank 150 to the observation chamber 112. As shown in FIG. 17, oxygen is supplied from the oxygen tank 150 via conduit 158. To supply oxygen to the observation chamber 112, the pneumatic valve 178 is desirably opened by rotating the oxygen actuating mechanism 250. As shown in the previous figures, the observation chamber 112 is open to the surrounding water environment but traps accumulated oxygen supplied by the conduit 158. The level of oxygen within the observation chamber 112 is desirably kept constant by a continuous flow of oxygen from the tank 150. The level of oxygen within the observation chamber 112 is desirably greater than or equal to the amount of carbon dioxide exhaled by the user 144. The volume of oxygen within the observation chamber 112 is desirably maximized such that when a greater volume of oxygen flows in to the observation chamber 112 via conduit 158, exhaled carbon dioxide and oxygen within the observation chamber 112 is forced out of the observation chamber 112. As shown in FIG. 18, exhaled gases such as carbon dioxide and oxygen may exit the observation chamber 112 via an air expulsion valve 270. This air expulsion valve 270 is desirably located in a lower portion of the main section 102 below the shoulder level of a user 144. Desirably, the air expulsion valve 270 is located at the surface level of the water environment within the observation chamber 112 to promote air circulation within the observation chamber 112. Expelled air then flows through the expulsion conduit 272 and out the exit valve 274. The continuous circulation and flow of air allows for a breathable concentration of oxygen within the observation chamber 112. Desirably, this arrangement avoids the need for the user 144 to use a regulator or for the user 144 to understand how to operate a regulator.

Figure 19:
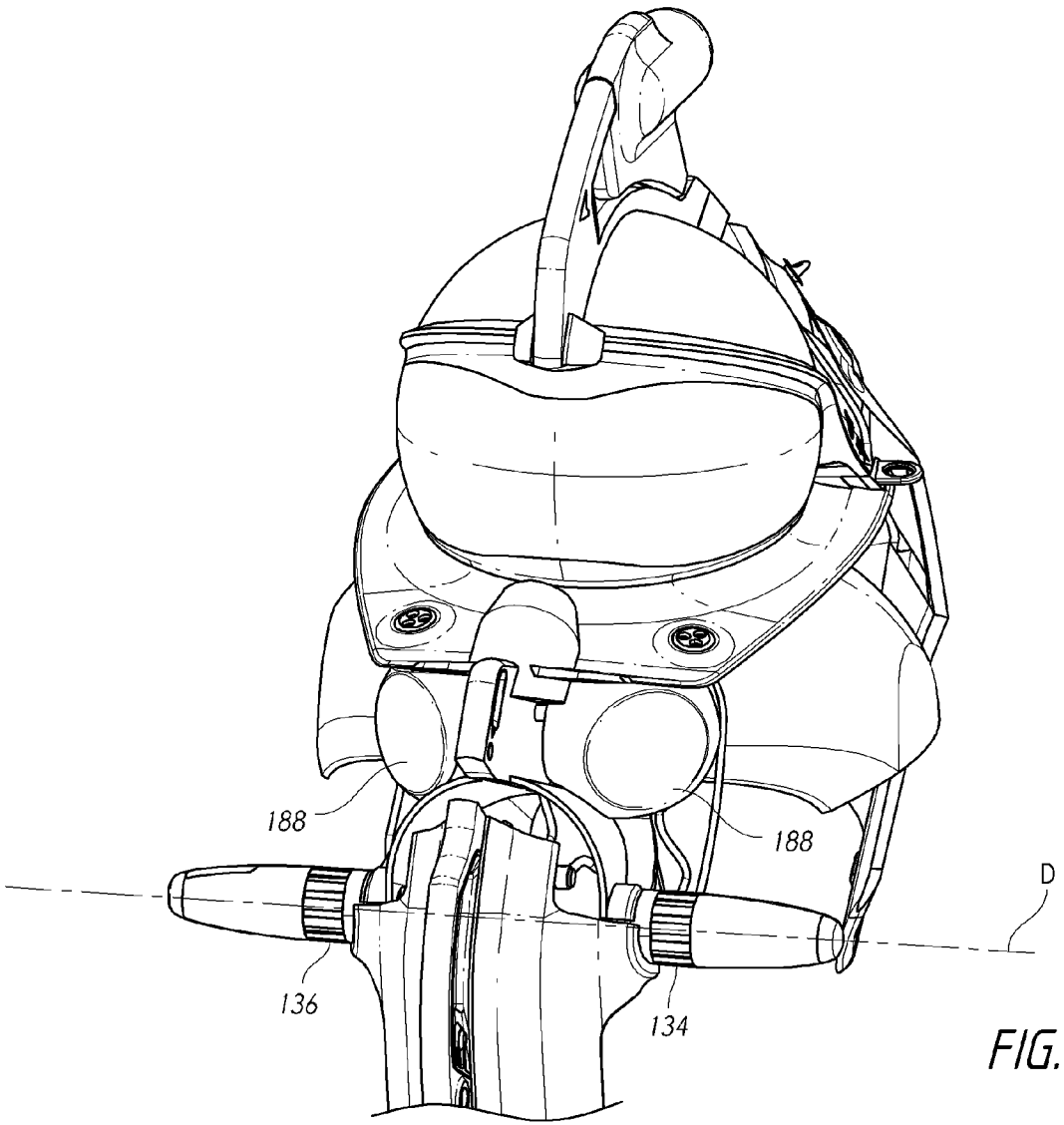
FIG. 19 is a partial front view of an underwater personal mobility device illustrating one location of the buoyancy bags.

With further references to FIGS. 1-4, the personal underwater mobility device 100 may further include the lower section 106 that may rotate with respect to the main section 102 about an axis defined by the connection between a lower section mechanical linkage 170 and the chassis 104 (see FIG. 8 and axis D in FIG. 19). The lower section 106 may be rotatably secured to the main section 102 via the chassis 104. Rotation of the lower section 106 desirably allows the device 100 to fold into a folded or collapsed configuration (see FIGS. 10-13) for ease of transport and storage. The lower section 106 may extend downward to an open or standard operating position when the device 100 is in use. In some embodiments, including the illustrated embodiment, when the lower section 106 is in a standard operating position, the lower section 106 is expanded approximately 90 degrees from the folded or collapsed configuration or from the mating surface of the main section 102 and the chassis 104. The lower section 106 may further comprise a plurality of handles 146, 148 to assist with transporting the device 100. In some embodiments, including the illustrated embodiment, the lower section 106 may further include at least one wheel 126. The size of the at least one wheel 126 may vary depending on the type of terrain the device 100 may be rolled across, such as packed or loose sand, a boat deck, a dock, etc. In some embodiments, including the illustrated embodiment, the at least one wheel 126 may have a diameter between 2 inches and 10 inches, more desirably between 4 inches and 9 inches, and most desirably between 5 inches and 7 inches. In some embodiments, including the illustrated embodiment, the at least one wheel 126 may have a diameter of at least 2 inches, at least 4 inches, at least 5 inches, or at least 6 inches.

Figure 12:
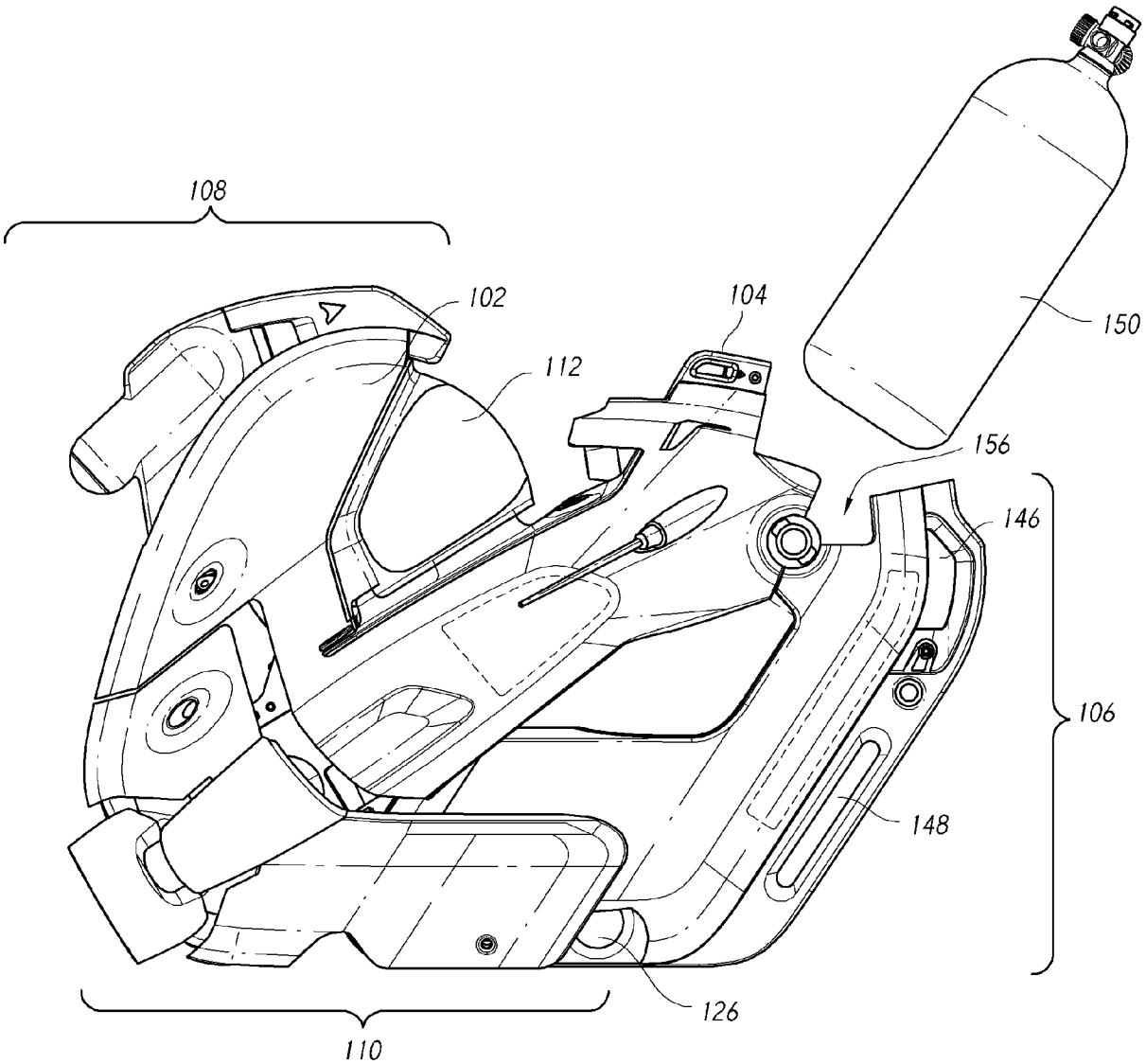
FIG. 12 is a second right side view of a folded orientation of an underwater personal mobility device illustrating the insertion of an oxygen tank into an oxygen tank compartment.

Breathable air to the observation chamber 112 may be provided from an oxygen tank 150 located within an oxygen tank storage space or compartment 156 located in the lower section 106 of the device 100. In some embodiments, the oxygen tank 150 may be mounted within the lower section 106. In some embodiments, including the illustrated embodiment, the mount at least partially defines a cylindrical surface of the compartment 156 which defines the opening to receive the oxygen tank 150. In some embodiments, including the illustrated embodiment, the oxygen tank compartment 156 is a cylindrical space configured to at least partially support the oxygen tank 150. The oxygen tank 150 desirably is secured within the oxygen tank compartment 156 when the device 100 is in an unfolded or operating configuration, as shown in FIG. 1A. Desirably, the center of gravity B of the oxygen tank 150 is positioned in front of the observation chamber 112 when the device is in an unfolded configuration. Desirably, the axis of the storage space or compartment 156 and the oxygen tank 150 are coincident (axis C in FIG. 1A) when the oxygen tank 150 is within the compartment 156. The oxygen tank 150 desirably is inserted into the storage space 156 in a direction parallel to the axis of the compartment 156, as shown in FIG. 12.

The oxygen tank 150 is preferably a standard size oxygen tank for scuba applications. In some embodiments, the oxygen tank 150 desirably is an 80 cubic foot standard aluminum scuba tank having a weight when empty of about 30 lbs and a weight when full of about 50 lbs. In some embodiments, including the illustrated embodiment, the oxygen tank 150, when full, weighs between about 30 lbs and about 100 lbs, between about 40 lbs and about 80 lbs, or between about 30 lbs and about 60 lbs. In some embodiments, including the illustrated embodiment, the oxygen tank 150, when empty, weighs between about 10 lbs and about 60 lbs, between about 20 lbs and about 50 lbs, or between about 30 lbs and about 40 lbs. In some embodiments, including the illustrated embodiment, the oxygen tank 150 has a length of between about 15 inches and about 40 inches, between about 20 inches and about 35 inches, or between about 25 inches and about 30 inches. In some embodiments, including the illustrated embodiment, an outside diameter of the oxygen tank 150 is between about 3 inches and about 10 inches, between about 5 inches and about 9 inches, or between about 6 inches and about 8 inches.

Selection of the location of the oxygen tank 150 affects the overall balance and stability of the submersible device 100. The weight of the oxygen tank 150 is part of the overall buoyancy and balance of the device 100 to keep the device 100 stable and upright (observation chamber 112 above the lower section 106) within the water. The oxygen tank 150 is also placed within the compartment 156 to provide easy access to the tank 150 when the device 100 is in a folded configuration, such as that shown in FIG. 12. Furthermore, placement of the oxygen tank 150 within the oxygen tank compartment 156 close to the wheel 126 allows the device 100 to be maneuverable and stable while be pulled on the wheel 126 while on land. Desirably, the center of gravity of the oxygen tank 150 is located forward of the axis of the wheel 126 when the device 100 is in a folded configuration such that the device 100 may be easily rotated about the wheel and pulled and transported on land. With the center of gravity of the oxygen tank 150 located forward of the axis of the at least one wheel 126 when the device 100 is in a folded configuration, the device 100 may be easily tipped forward to roll on the at least one wheel 126 along a boat deck, dock, or other surface. The remaining weight of the device 100, such as the rear section 110 and main section 102, counterbalance the forward tipping force to make the device 100 easy to pull and transport. Desirably, the handle 146 is located substantially above the at least one wheel 126 and the folding section is rotated such that the lower section 106 is located substantially in front of the at least one wheel 126. Desirably, the device 100 requires between about 20 lbs and about 40 lbs of pressure to pull and roll along a surface.

One or more additional backup oxygen tanks may be provided, as discussed in greater detail below. Additionally, in some embodiments, including the illustrated embodiment, the lower section 106 may include a battery compartment 196. The batteries may be used to power the instrument panel 124, the propulsion mechanism 120, or any other electrical system on the device 100.

With continued reference to FIGS. 1-4, in some embodiments, including the illustrated embodiment, the main section 102 may further include the upper section 108. The upper section 108 may include a buoy 140 located above the observation chamber 112 to provide a buoyant force to orient the device while underwater. In some embodiments, including the illustrated embodiment, including the illustrated embodiment, the buoy 140 may be deployable on a tether connected to the personal underwater mobility device 100. During operation of the device underwater, the deployable buoy 140 can be released from the main section 102 and float on the surface of the water, providing an indication to boats and other water craft of the underwater location of the device 100. The buoyancy of the buoy 140 may also be used as an additional safety device to prevent the underwater personal mobility device 100 from exceeding a predetermined depth. The buoy 140 may include a light 141 to provide additional information as to the location of the device 100 when the device 100 is in the water. The light 141 may glow or flash to indicate that the device 100 is submerged.

In some embodiments, including the illustrated embodiment, the upper section 108 may further include a snorkel 154. The snorkel 154 is preferably fluidly connected to the observation chamber 112 to provide breathable air to the observation chamber 112 while the device 100 is out of the water or prior to a diving operation. The snorkel 154 also provides a conduit for air exhaled by the user 144. The bubbles rising from the snorkel 154 may provide an additional indication of the underwater location of the device 100.

As most clearly seen in FIGS. 4, 5, and 7A-C the main section 102 may, in some embodiments, including the illustrated embodiment, include the rear section 110. The rear section 110 may be formed from hydrodynamic panels including right lower body contact panel 114 and left lower body contact panel 116 (shown in FIG. 8). The rear section 110 may rotate left (as shown by direction A) and right (as shown by direction B) with respect to the main section 102 such that the user 144 can control the direction of motion of the underwater personal mobility device by twisting his or her lower body left and right and applying pressure on the right and left lower body contact panels 114, 116. The contact panels 114, 116 may have a resin or plastic external surface that is hydrodynamic to allow the device 100 to move through the water with minimal resistance. An interior surface of the contact panels 114, 116 that contacts the user's body may be formed from a softer material such as silicone. In some embodiments, including the illustrated embodiment, the rear section 110 also includes the propulsion mechanism 120. Desirably, the rear section 110 rotates left and right (directions A and B, as shown on FIG. 5) in response to pressure from the user's hips and sides. Rotation of the rear section 110 also rotates the propulsion mechanism 120 left and right, to control the direction of travel of the device 100, thereby eliminating additional hardware and simplifying manufacturing of the device 100. In other embodiments, the rear section 110 remains stable and the propulsion mechanism 120 rotates relative to the rear section 110 to control the direction of travel of the device 100.

Figure 6:
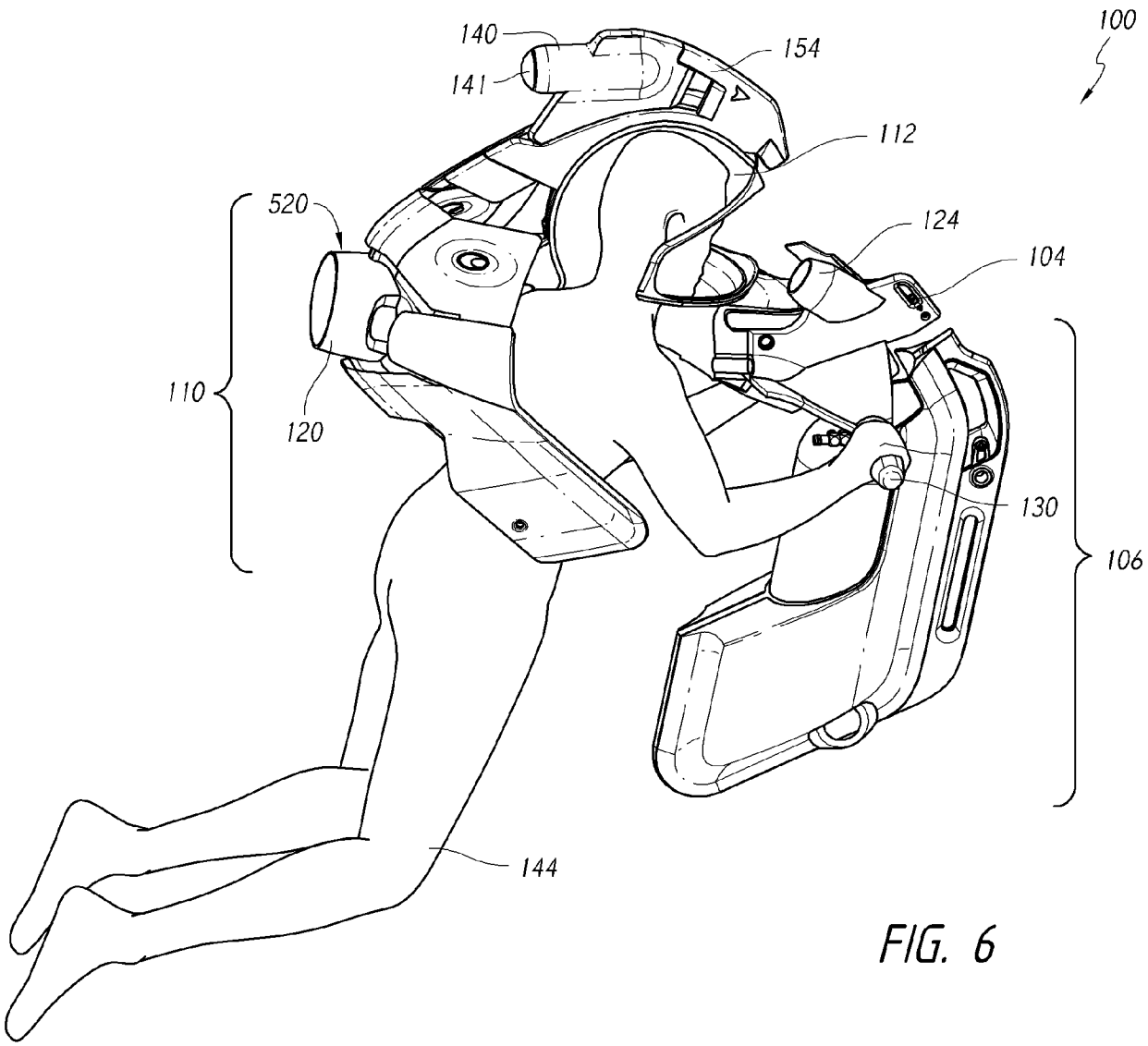
FIG. 6 is a partial perspective rear right view of an underwater personal mobility device and a user thereof.

FIGS. 6 and 7 illustrate, in partial cross-section, a user 144 interacting with the device 100. In one embodiment, including the illustrated embodiment, the user 144 is inclined in a generally upright position, not seated, with his or her legs extending below and behind the device 100. Desirably, the majority of the user's body is not constrained by the device 100, allowing the user 144 to move intuitively once submerged. Desirably, at least the user's head and shoulders fit within the observation chamber 112, allowing the user 144 to clearly view the environment in front of and peripheral to the device 100. The user 144 may also desirably clearly read the information displayed in the instrument panel 124 from inside the observation chamber 112. The lower section 106 is preferably formed from hydrodynamic panels that allow the device 100 to easily move through the water.

Figure 7A:
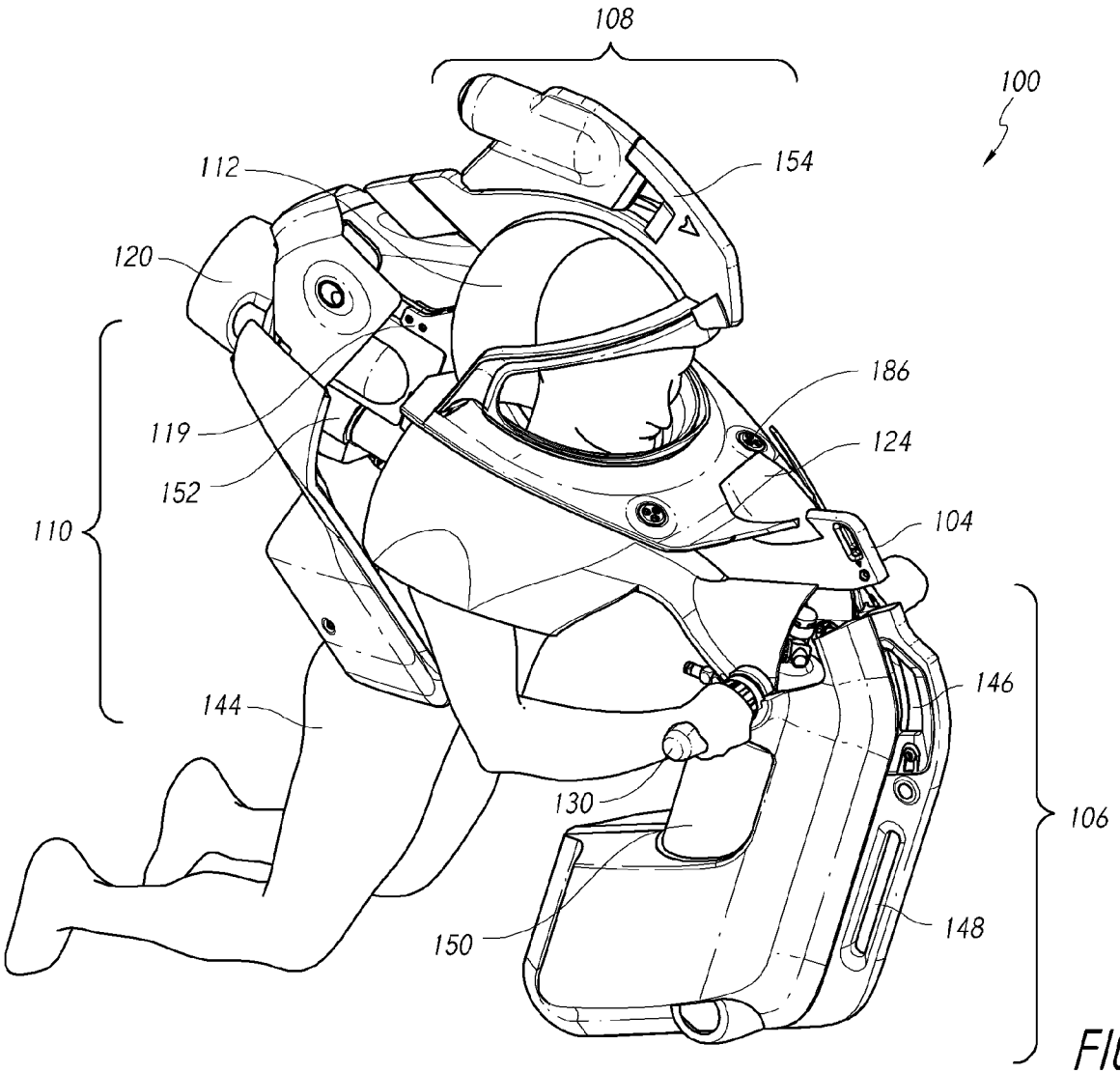
FIG. 7A is a partial perspective front right view of an underwater personal mobility device and a user thereof.
Figure 7B:
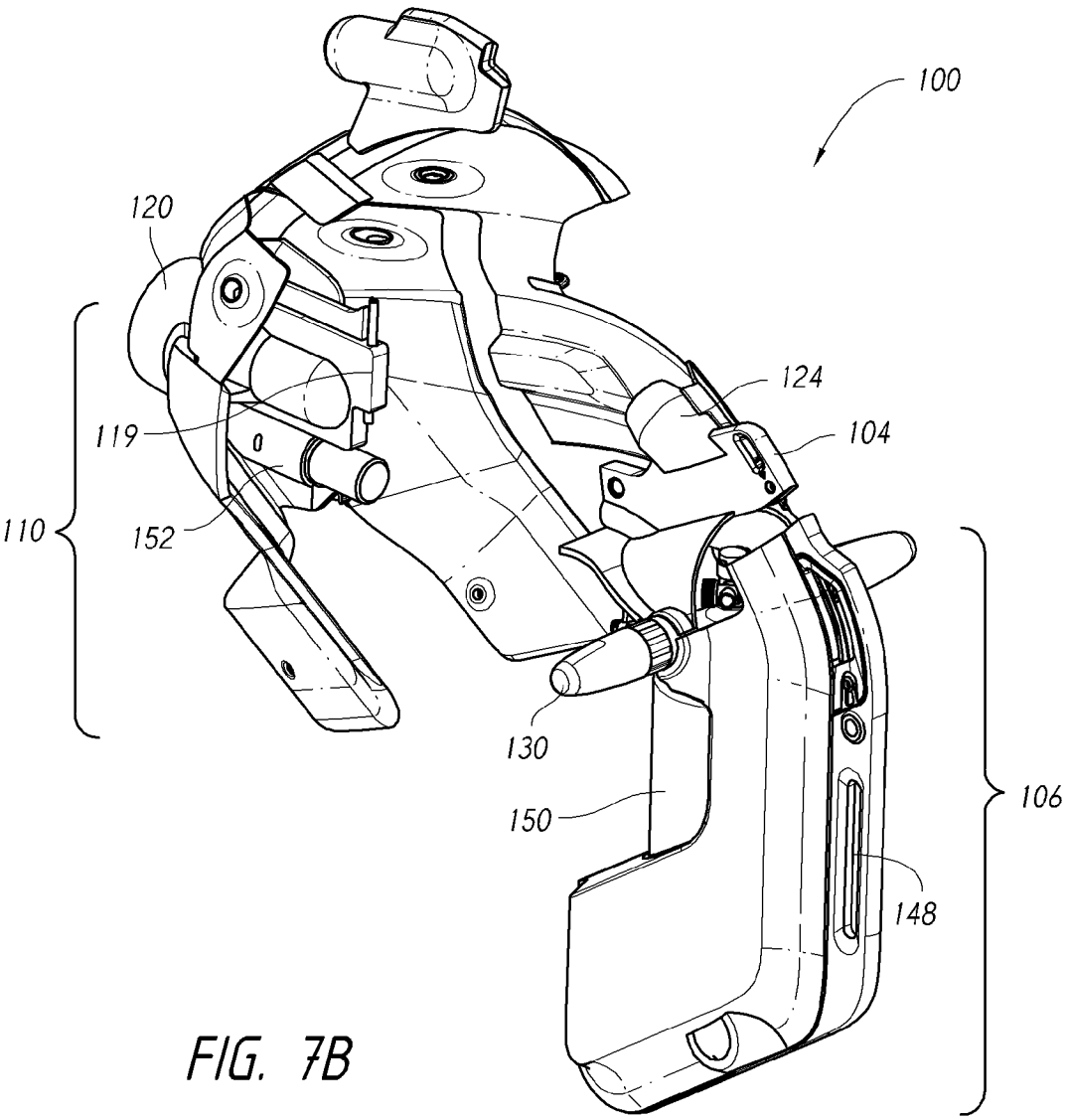
FIG. 7B is a partial perspective right front view of an underwater personal mobility device shown without a user.
Figure 7C:
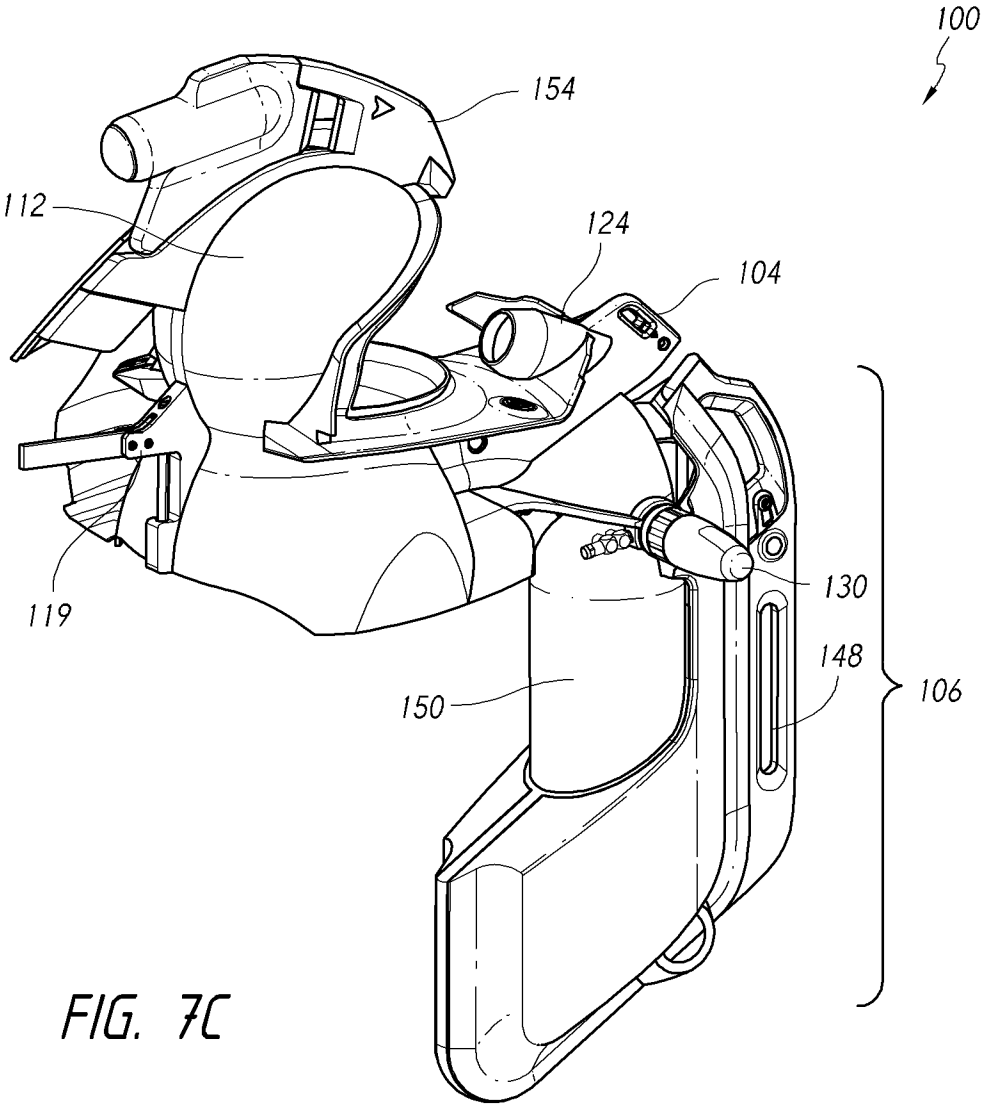
FIG. 7C is a partial perspective rear right view of an underwater personal mobility device.

In some embodiments, including the illustrated embodiments shown in FIGS. 6 and 7, during operation, the user's hips or sides contact the interior surface or steering surface of the right and left lower body contact panels 114, 116. To steer the device 100, the user 144 intuitively moves or rotates his or her body left or right. The rear section 110 rotates about a rear linkage 119 (FIGS. 7B and C) right or left depending on the pressure exerted by the user 144 on the interior surface or steering surface of the right and left lower body contact panels 114, 116. The handle 130, 132 act as anchor points in order to counterbalance the user 144 as the user 144 rotates their lower body.

As further illustrated in FIGS. 6 and 7A and B, a secondary oxygen tank 152 may be located within the interior of the rear section 110. The secondary oxygen tank 152 can be an additional source of oxygen in case of malfunction or depletion of the primary oxygen tank 150.

Figure 10:
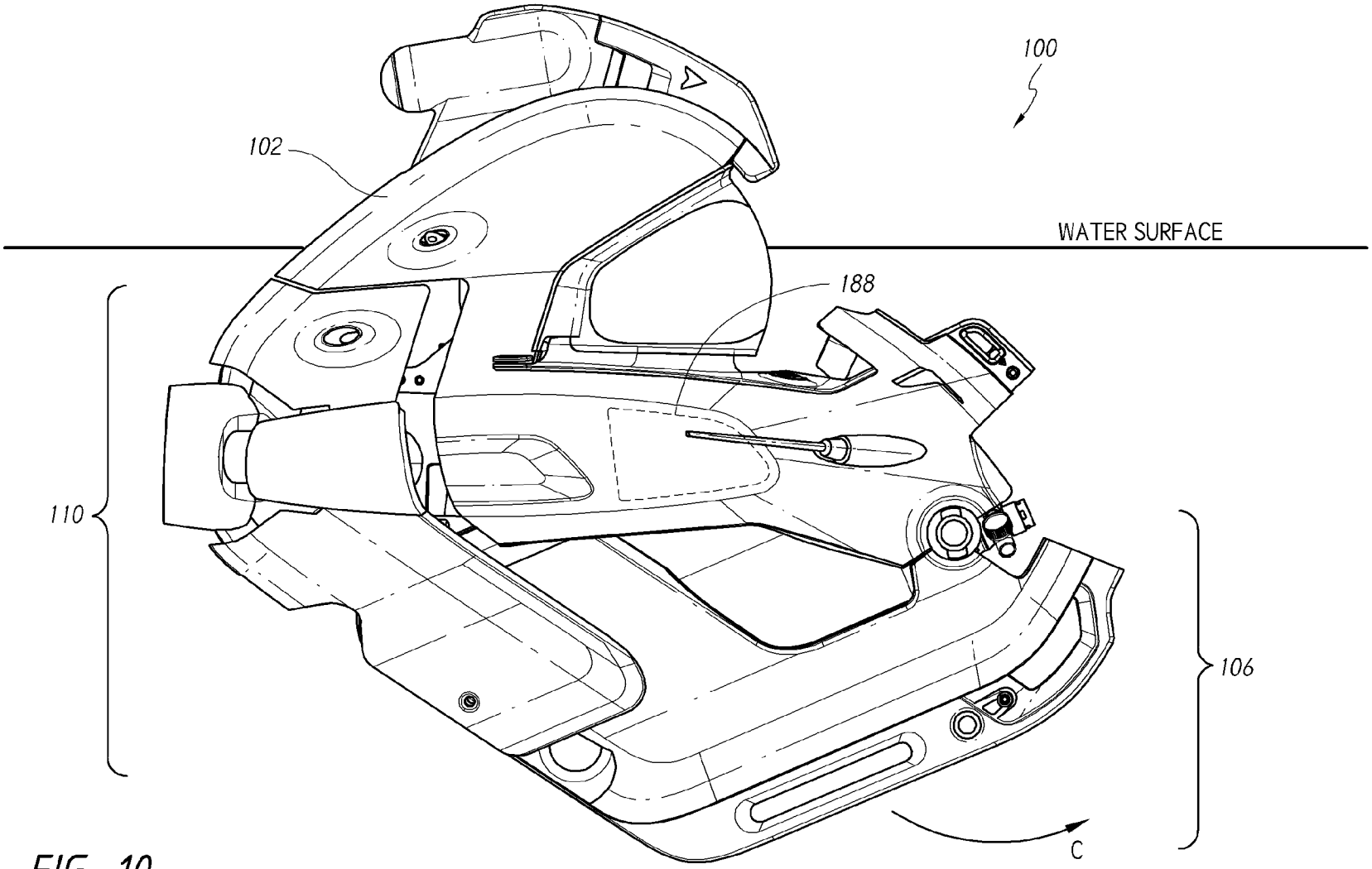
FIG. 10 is a right side view of a folded orientation of an underwater personal mobility device.

The buoyancy of the device 100 may be controlled by the user 144 during operation. FIGS. 3 and 10 illustrate the position, in one embodiment, of at least one adjustable buoyancy bag or chamber 188 and a ballast area 189. Desirably, at least most, and in some cases all, of the at least one buoyancy bag 188 is located in the main section 102. Desirably, the buoyancy bag 188 is forward of the user's chest. Desirably, the buoyancy bag 188 is above the lower section linkage 170 such that the at least one buoyancy bag 188 is above the axis of rotation of the lower section that is defined by the lower section linkage 170 (axis D in FIG. 19). Desirably, the buoyancy bag 188 is located near to the center of gravity of the device 100. In some embodiments, including the illustrated embodiment shown in FIG. 19, the device 100 may include two buoyancy bags 188 located to the left and right of a plane of symmetry of the device 100. In some embodiments, including the illustrated embodiment, the buoyancy bag 188 is located within about 3 feet of the center of gravity of the device 100, more desirably within about 1.5 feet of the center of gravity of the device 100, and most desirably within about 10 inches of the center of gravity of the device 100.

The ballast area 189 may consist of a varied amount of weight, depending on the morphology of the user 144 and the specific purpose of use of the device 100 (e.g., shallow water exploration or deep water exploration). Similarly, the buoyancy bag 188 may be inflated or deflated depending on the morphology of the user and the specific use of the device desired by the user 144 (e.g., accelerating or decelerating the rate of ascent or descent or achieving neutral buoyancy). Additionally, in some embodiments, including the illustrated embodiment, the level of inflation of the buoyancy bag 188 may be controlled by the user 144 via the handles 130, 132. The personal underwater mobility device 100 may further include a battery compartment 196, as seen in FIGS. 3 and 8. In some embodiments, including the illustrated embodiment, the battery compartment 196 may provide power for an electric motor included in propulsion mechanism 120, or any other purpose requiring electricity (e.g., sensors or warning signals) and may also provide additional weight for inclusion in the calculation of neutral buoyancy of the device 100 when submerged underwater.

FIG. 8 depicts an exploded view of a preferred embodiment of the present invention. FIG. 9 depicts a closer exploded view of the main section 102 and chassis 104 of the device 100. Underwater personal mobility device 100 includes the main section 102 that, in the illustrated arrangement, is further comprised of observation chamber 112. As shown, a rear portion of the observation chamber 112 may be integrated into and formed together with the main section 102. However, a viewing portion 190 of the observation chamber 112 may be formed from a clear or "see through" material allowing the user to view the surrounding environment while underwater. As seen most clearly in FIG. 9, this viewing portion 190 may, in some embodiments, including the illustrated embodiment, be shaped substantially as a half hemisphere allowing the user 144 a greater range of vision and may be attached, as in the present embodiment, with a curved viewing attachment piece 192. The viewing attachment piece 192 preferably wraps around the circumference of the viewing portion 190 in order to seal the edges where the viewing portion 190 meets the observation chamber 112 in order to substantially prevent the intrusion of water. Other known methods of attaching the viewing portion 190 to the observation chamber 112 may be used (e.g., liquid sealants).

The observation chamber 112 shown in FIGS. 1-14 may further include at least oxygen sensor or carbon dioxide sensor. The oxygen transfer conduit 158 preferably connects the observation chamber 112 and the oxygen tank 150 to provide breathable air to the observation chamber 112. In some embodiments, including the illustrated embodiment, the oxygen transfer conduit 158 also passes through the chassis 104. The chassis 104 may connect the main section 102 to the lower section via the lower section linkage 170, as discussed above. In some embodiments, including the illustrated embodiment, the amount of air contained within the observation chamber 112 may remain the same at all times. Furthermore, in some embodiments, including the illustrated embodiment, the constant flow of air preferably maintains a mix of carbon dioxide and oxygen to ensure a proper, breathable mixture is maintained for the user 144.

In some embodiments, including the illustrated embodiment, the observation chamber 112 can be configured to provide a volume of air of 40 liters. Alternative embodiments may have an observation chamber 112 that is configured to provide a volume of air between 10 liters and 100 liters, desirably between 20 liters and 80 liters, more desirably between 30 liters and 70 liters, and even more desirably between 40 liters and 60 liters. However, depending on the morphology of the user 144, this volume of air may vary and therefore influence the neutral buoyancy of the overall device 100. In some embodiments, including the illustrated embodiment, the user 144 can adjust the volume of air inside the buoyancy bag 180 in order to suit different body types. Further, in other embodiments, including the illustrated embodiment, the volume of air within the observation chamber 112 can desirably be adjusted to keep the entire device 100 stable and neutrally buoyant under water.

In some embodiments, including the illustrated embodiment, the device 100 may further comprise an upper section 108. The upper section 108 may comprise the deployable buoy 140 and the light 141. Additionally, as discussed above, in some embodiments, the upper section 108 may also include a snorkel 154 to allow breathable air to enter the observation chamber 112 when the device 100 is out of the water or when at least the upper section 108 of the device is above the surface of the water.

The main section 102 may further include a buoyancy bag 188. In some embodiments, including the illustrated embodiment, the shape of the main section 102 can be configured to allow the user 144 to freely move his arms during operation of the device 100 and may also allow the lower body portion of the user 144 to interact with the environment outside of the main section 102 of the device 100. Additionally, the main section 102 may be further comprised of at least one handle 130, 132 which may be grasped by the hands of a user 144 for stability while underwater or to provide guidance and direction for the underwater personal mobility device 100. For example, the user 144 may be able to grab the handles 1130, 132 but may also have the full use of his hands for other needs while operating the device 100. For example, in some embodiments, including the illustrated embodiment shown in FIG. 8, user graspable handles 130, 132 can include actuating mechanisms 134, 136 which may desirably include a throttle and an on/off switch by which the motor can be operated to control propulsion of the device 100. In some embodiments, the actuating mechanisms 134, 136 may be detent mechanisms. Further, in some embodiments, including the illustrated embodiment, one of the handles 130, 132 can also include a pneumatic valve 178 to be used to control the volume inside the buoyancy bag 158 in order to control the depth of the device 100.

As shown in FIGS. 8 and 9 and as discussed above, the handles 130, 132 may be mechanically or electrically coupled to the air valves 180, 182 to permit the air valves 180, 182 to be controlled to adjust the amount of air within the buoyancy bag 188. The larger the volume of air within the buoyancy bag 188, the more buoyant the device 100. Conversely, when the buoyancy bag 188 contains a smaller volume of air, device 100 is less buoyant. For example, when the user 144 manipulates the handles 130, 132 by twisting one of the handles 130, 132 in one direction, the air valves 180, 182 may open, releasing air to the environment to decrease the volume of air within the buoyancy bag 188. When the user 144 twists one of the handles 130, 132 in an opposite direction, the air valves 180, 182 may close, preventing the escape of air from the buoyancy bag 188 to the environment. When the user 144 further turns the handles 130, 132, pneumatic valve 178 located within the handles 130, 132 may be commanded to allow air from the oxygen tank 150 to inflate the buoyancy bag 188. The handles 130, 132 each contain an actuating mechanism 134, 136 to activate the pneumatic valve 178 by rotation.

Figure 16:
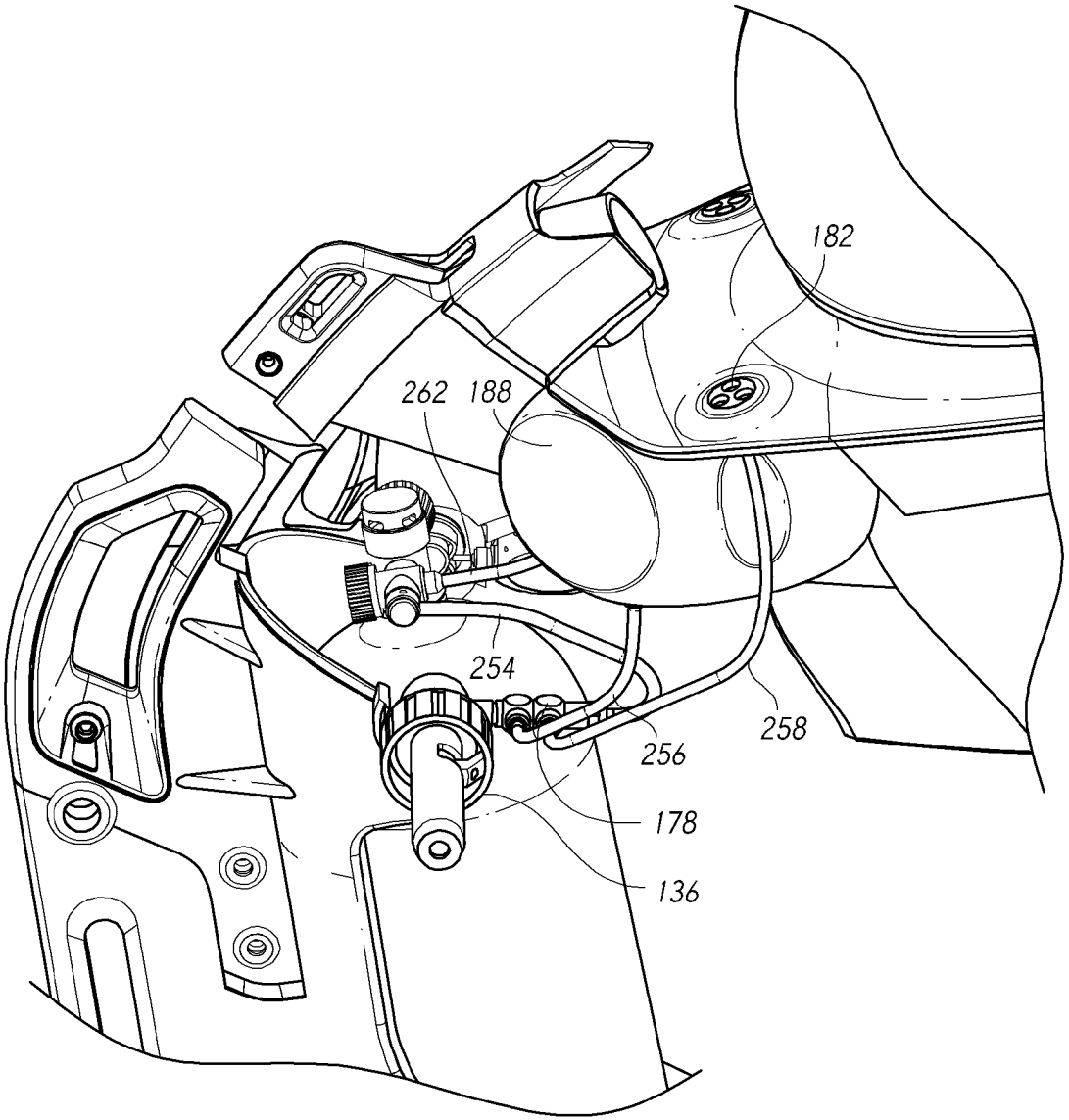
FIG. 16 is a partial left side view of an embodiment of oxygen connections and controls for an underwater personal mobility device.

In some embodiments, including the illustrated embodiment, the buoyancy of the device may be controlled by rotating the user graspable handle 132 clockwise. As illustrated in FIG. 16, the actuating mechanism 136 will actuate the pneumatic valve 178. Oxygen from the oxygen tank 150 via an oxygen conduit 254 supplies oxygen to the pneumatic valve 178. When the valve is actuated to supply oxygen to the buoyancy bag 188 to increase the buoyancy of the device, oxygen passes through the conduit 256 to inflate the buoyancy bag 188. By inflating the buoyancy bag 188, the buoyancy of the submersible 100 becomes positive or more positive and the submersible 100 ascends to a shallower depth in the water. In some embodiments, two buoyancy bags may be located symmetrically on either side of the observation chamber 112 and both buoyancy bags may be connected by a conduit.

To reduce the buoyancy of the submersible 100, the pneumatic valve 178 may be actuated by rotating the user graspable handle 132 counter-clockwise. The actuating mechanism 136 will actuate the pneumatic valve 178 to close the oxygen conduit 254 to prevent oxygen from flowing from the oxygen tank 150. The pneumatic valve 178 will open to allow oxygen to flow through conduit 258. The flexible buoyancy bag 188 is under pressure determined by the depth of the submersible 100. Thus, oxygen from the buoyancy bag 188 flows through the conduit 156 and, via the pneumatic valve 178, though the conduit 258 and out the oxygen valve 182 to the surrounding external environment. By deflating the buoyancy bag 188, the buoyancy of the submersible 100 becomes negative or more negative and the submersible 100 descends to a deeper depth in the water.

In some embodiments, including the illustrated embodiment, an exit conduit 262 may be provided in case the pressure inside the buoyancy bag 188 becomes greater than a predetermined threshold value. When the pressure is greater than the predetermined value, oxygen may be allowed to exit the buoyancy bag 188 through the exit conduit 262 and to the external environment via the oxygen valve 182. The buoyancy bag 188 and the ballast area 189 are positioned to achieve a balanced, substantially upright configuration of the device 100, as shown in FIGS. 1-7 and 10.

As shown in FIG. 17, the user graspable handle 132 may be connected to the actuating mechanism 134. The actuating mechanism 134 may be connected to an on/off mechanism 280 to turn the propulsion system 120 on or off. In some embodiments, the on/off mechanism may be an infrared transponder.

In general, the handles 130, 132 are not movable with respect to the main section 102 but in some embodiments, including the illustrated embodiment, the handles 130, 132 may be able to fold closer to the side of the main section 102 for ease of transport and storage of the device 100.

FIG. 8 also depicts the personal underwater mobility device 100 with main body panels 160, 164 that desirably attach to either side of the personal underwater mobility device 100 below the observation chamber 112. The main body panels 160, 164 may be attached using any suitable means (e.g., mechanical fasteners). Lower section panels 162 and 166 desirably attach to either side of the lower section 106 and may also be attached using any suitable means (e.g., mechanical fasteners). The main body panels 160, 164 and the lower section panels 162, 166 provide a hydrodynamic surface to allow the device 100 to move easily through the water with minimal drag or resistance. The main body panels 160, 164 and the lower section panels 162, 166 desirably provide a non-sealing protective enclosure for the main section 102 of the personal underwater mobility device 100 and the lower section 106. In some embodiments, including the illustrated embodiment, the main body panels 160, 164 and the lower section panels 162, 166 may not be solid but may include various openings to provide comfort and utility for the user 144 to interact with the device 100, such as openings allowing freedom of movement of the elbows and arms of a user 144.

As further illustrated in FIG. 8, the lower section 106 may further comprise a center lower section portion 168. In some embodiments, including the illustrated embodiment, the center lower section portion 168 includes the battery compartment 196 and the oxygen storage compartment 156. The center lower section 168 desirably attaches to a lower section linkage 170 using any suitable attachment means (e.g., mechanical fasteners). The lower section 106 may be secured to the main body via the lower section linkage 170 that is preferably secured to chassis 104 such that the lower section 106 is allowed to rotate. The lower section linkage 170 desirably attaches to the chassis 104 at the attachment points 172, 174 using any known type of mechanical fasteners. Desirably, the lower section 106 may pivot about the axis defined by the attachment points 172, 174 between the lower section linkage 170 and the chassis 104 such that the lower section 106 may be in a folded or collapsed configuration or an open or standard operating condition. In some embodiments, including the illustrated embodiment, the lower section linkage 170 can interconnect all of the lower components of the device 100, such as the lower section 106, to the chassis 104 and the main section 102 of the device 100.

In some embodiments, the device 100 may not include a chassis 104. In these embodiments, the lower section linkage 170 can interconnect the lower components of the device 100, such as the lower section 106, directly to the main section 102 of the device 100. Additionally, in embodiments of the device 100 that do not include chassis 104, the lower section 106 may pivot about an axis defined by attachment points between the main section 102 and the lower section linkage 170 such that the lower section rotate such that it is in a folded or collapsed configuration or an open or standard operating condition.

With continued reference to FIG. 8, the rear section 110 further comprises lower body contact panels 114, 116. A left contact surface 117 is located on an interior surface of the left body contact panel 114 and a right contact surface 115 is located on the interior surface of the right body contact panel 116. During operation of the device 100, the left side of the user's body will contact the left contact surface 117 and similarly the right side of the user's body will contact the right contact surface 115. The left contact surface 117 and the right contact surface 115 may made from a soft material such as rubber or silicone to cushion the user's body and increase the user's comfort while operating the device 100. In some embodiments, including the illustrated embodiment, the left contact surface 117 and right contact surface 115 may be interchangeable and customizable to fit different user morphologies. The left and right contact surfaces 117, 115 provide a steering surface that the user 144 can press against with his or her lower body to steer the device 100.

Additionally, in some embodiments, including the illustrated embodiment, a propulsion mechanism 120 may be integrated into the device 100 and supported by the main section 102. FIG. 8 depicts a preferred embodiment in which the propulsion mechanism 120, including an electric motor in a housing connected via a shaft to a thruster or propeller, is located within the rear section 110 behind the observation chamber 112. The force applied by the motor on the propeller desirably directly propels the overall device 100 in the desired direction. In one embodiment, as illustrated in FIG. 8, the propulsion mechanism 120 may further include a rudder 122 which may be mechanically or electrically connected to the graspable handles 130, 132 so as to be controlled thereby to steer the submersible device. In one embodiment, the propulsion mechanism 120 may be enclosed within the rear section 110, as illustrated in FIG. 8. In other embodiments, the propulsion mechanism 120 may be located below the user 144, flanking the user 144, or incorporated into another section of the device 100.

The propulsion mechanism can be electric with preferably a 12 v, 24 v or 36 v electric motor preferably integrated into the rear section 110 and located above the back of the user 144. Desirably, the motor is attached to and rotates with the remainder of the rear section 110. The electric motor may be powered by batteries. The location of the batteries can desirably be part of the weight distribution resulting in the balance of the overall unit underwater. Power sources of other types (e.g., gasoline motors) with different power characteristics may also be used. In some embodiments, a water jet or pump jet may be used to propel the device 100.

As illustrated in FIGS. 1-8, the propulsion mechanism 120 (e.g., an electric motor and propeller, as shown in the illustration) may preferably be located substantially towards the rear of the rear section 110, above the body position of the user 144 when the user 144 is interacting with the device 100. However, in other embodiments, including the illustrated embodiment, the propulsion mechanism 120 may be attached to the chassis 104 or at some other location within the device 100, such as below or to the sides of the body position of the user 144. The propulsion mechanism 120 may be integrated into the rear section 110 as shown in FIGS. 1-8. In these embodiments, including the illustrated embodiment, the rear section 110 may further comprise a propulsion mechanism cover or housing 520. This cover or housing 520 surrounds the propulsion mechanism 120 to preferably both protect the user 144 from possible injury from moving parts of the propulsion mechanism 120 and also to provide protection for the propulsion mechanism 120. The cover or housing 520 may, in some embodiments, including the illustrated embodiment, provide a further benefit similar to that of a nozzle and may be rotatable in order to change the direction of movement of the device 100. The cover or housing may be formed into one continuous piece or may be separated into two pieces.

A folded or collapsed configuration of device 100 is shown in FIGS. 10-13. FIG. 10 illustrates the device 100 in a neutrally buoyant position in the water such that the upper section 108 and at least a part of the main section 102 is above the surface of the water and the depth of the device 100 is holding stable. In this stable or neutrally buoyant position, the snorkel 154 is above the surface of the water and may be used to provide breathable air to the observation chamber 112, preserving the oxygen within the oxygen tank 150 for use when the device 100 is submerged below the surface of the water.

Figure 11:
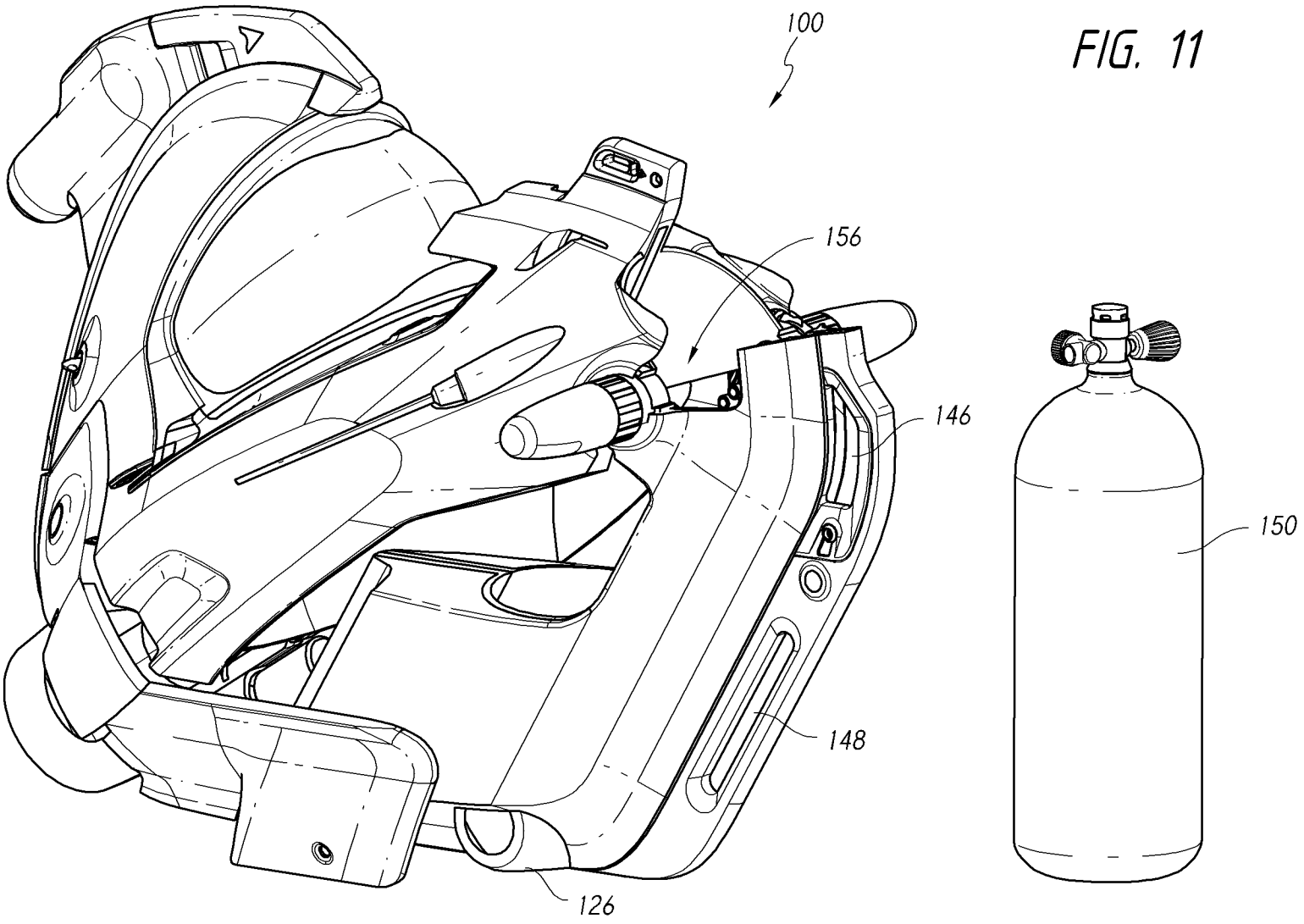
FIG. 11 is a lower right perspective view of a folded orientation of an underwater personal mobility device and oxygen tank shown from the lower front of the device.
Figure 13:
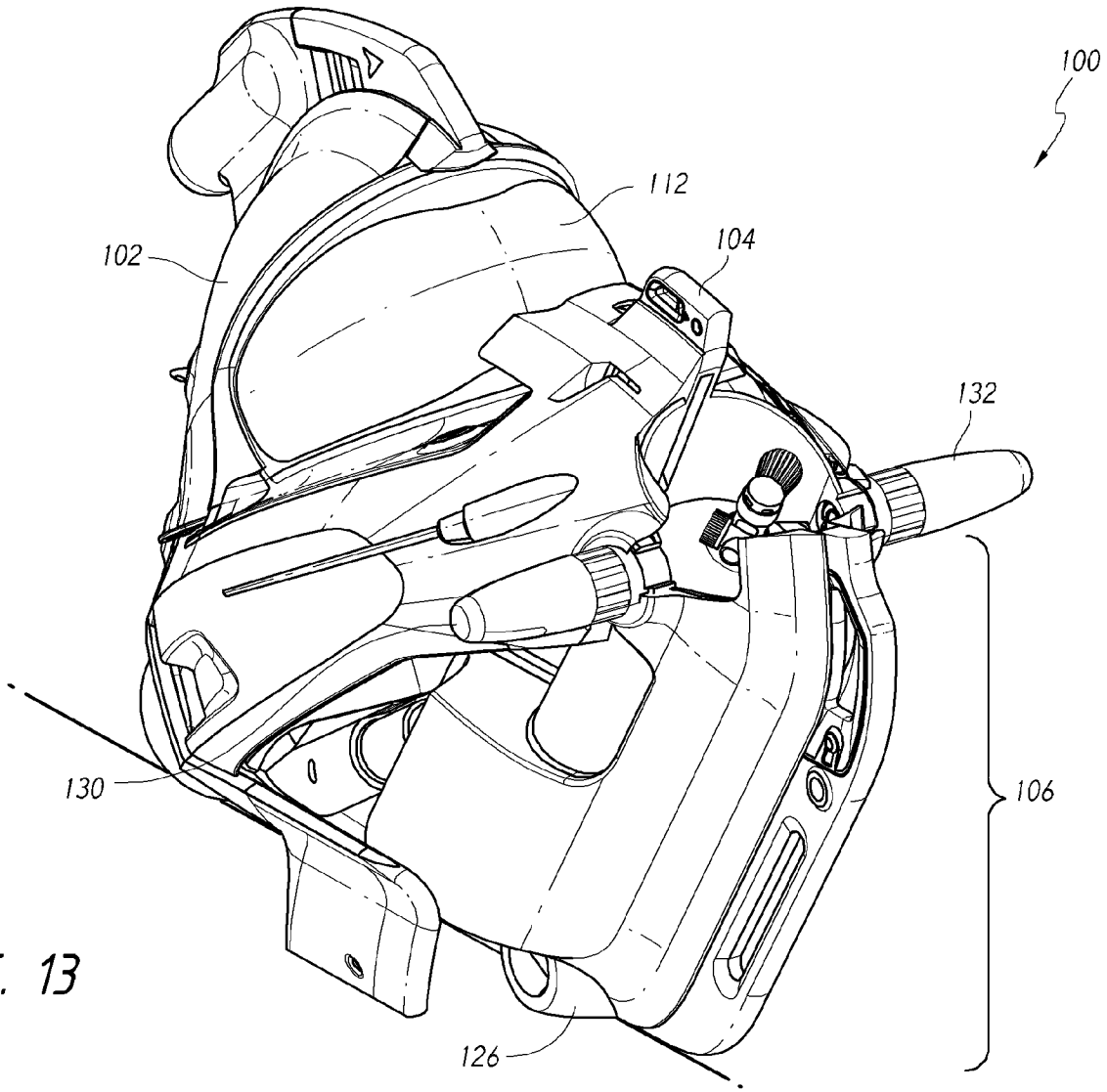
FIG. 13 is a second lower right perspective view of a folded orientation of an underwater personal mobility device with an oxygen tank installed in an oxygen tank compartment.

FIGS. 11-13 illustrate the insertion of the oxygen tank 150 into the oxygen storage compartment 156. In some embodiments, including the illustrated embodiment, insertion of the oxygen tank 150 is preferably accomplished when the device 100 is in a folded or collapsed configuration. When the device 100 is in the collapsed configuration, the opening to the oxygen storage compartment 156 is fully open, allowing the oxygen tank 150 to be inserted within the compartment 156. In some embodiments, including the illustrated embodiment, the oxygen storage compartment 156 will allow insertion of the oxygen tank 150 in a specific orientation such that the oxygen tank 150 can be fluidly connected to the oxygen transfer conduit 158 such that oxygen can travel from the oxygen tank 150 to the observation chamber 112. The oxygen tank 150 can be easily inserted or removed from the oxygen tank compartment 156 when the device 100 is in a folded or collapsed configuration. When the device is an unfolded or operating configuration, as shown in FIG. 1, the oxygen tank 150 desirably is secured within the oxygen tank compartment 156.

FIGS. 11-13 further illustrate the at least one wheel 126 and the grab handles 146, 148. The wheel 126 allows the device 100 to be more easily transported using the handles 146, 148, particularly when the device 100 is in a folded configuration. In some embodiments, including the illustrated embodiment, when the device is folded, the handles 146, 148 are preferably oriented in the direction of travel while the main section 102 is preferably located behind the wheel in order to facilitate better balance of the device 100 when the device 100 is being pulled or transported.

Figure 14:
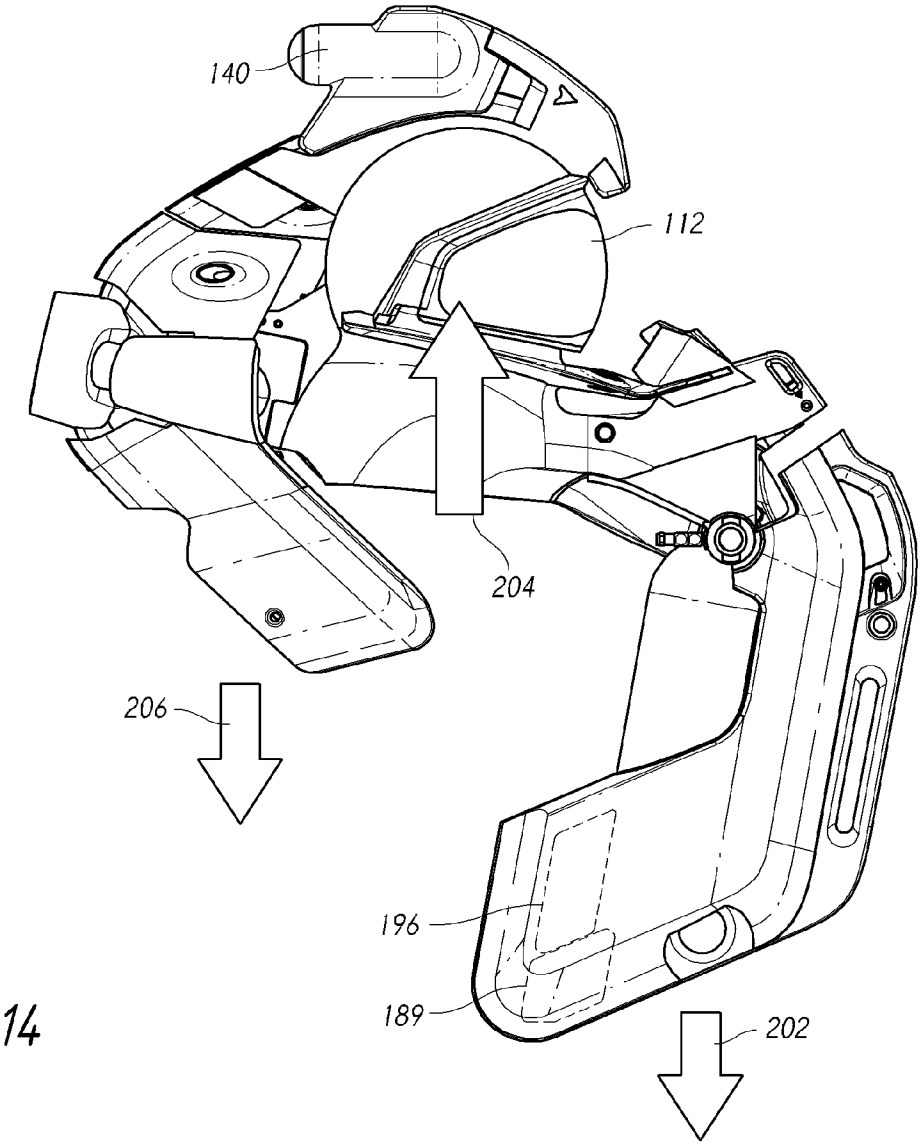
FIG. 14 is a partial right view of a buoyancy and ballast mechanism for an underwater personal mobility device.
Figure 15:
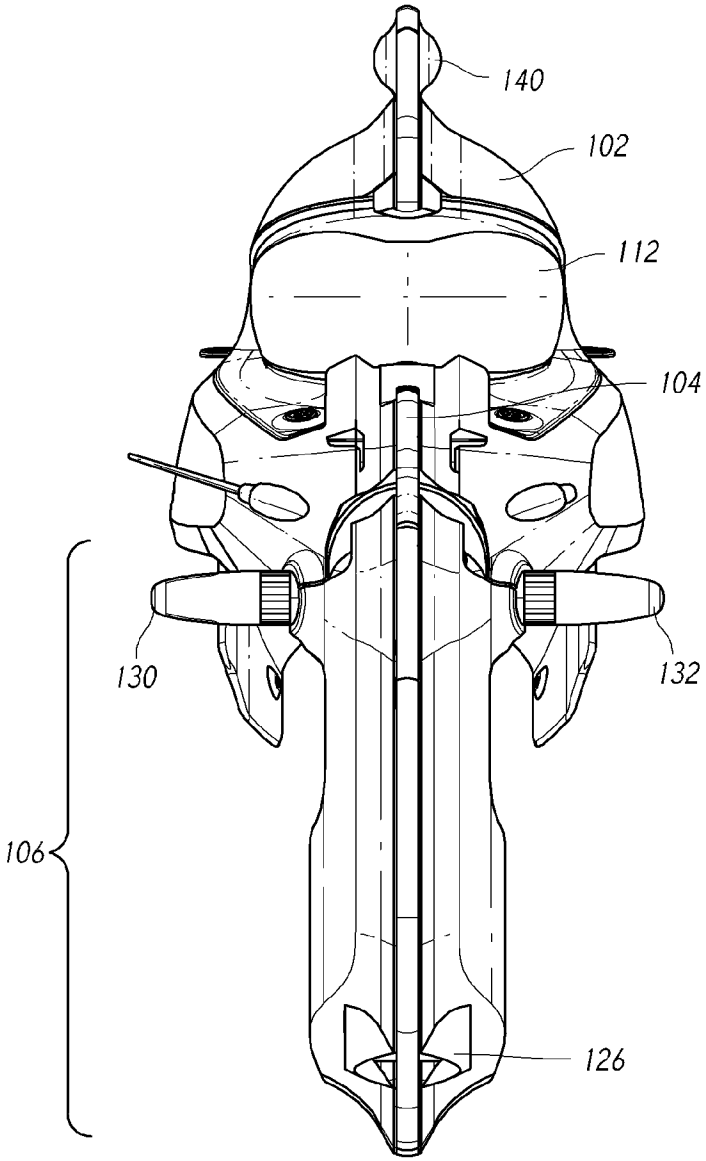
FIG. 15 is a front view of an underwater personal mobility device.

Desirably, the submersible device 100 remains vertically stable under water. In some embodiments, including the illustrated embodiment, the equalization of two opposite forces preferably keeps the unit neutrally buoyant and upright, as shown in FIG. 14. For example, the volume of air in the open observation chamber 112 results in an upward force acting to push the submersible device towards the surface. Additionally, the overall weight of the unit (including components such as the batteries, motor, and ballast) provides a force acting in the opposite direction. In some embodiments, including the illustrated embodiment, this stability can be important with the aim of keeping the volume of the observation chamber 112 open and clear of water, free for ingress or egress of the user.

In the embodiment illustrated in FIG. 14, the arrows represent the volumes of enclosed air which can apply vertical forces (shown with up arrows) pushing the underwater personal mobility device 100 up to the surface, and further represent volumes of high density weight materials which can apply vertical forces (shown with down arrows) pushing the underwater personal mobility device 100 down towards the bottom. The point of neutrality, or neutral buoyancy, can be calculated, for example, by the volumetric equation which takes into consideration the location in space of all of the volumes providing upward and downward forces. In the illustrated embodiment, the buoy 140 can be provided on the upper section 108 and preferably stays close to the surface of the water. Thus, in some embodiments, including the illustrated embodiment, the buoy 140 can prevent the unit from going deeper than a desired maximum depth. In some embodiments, including the illustrated embodiment, the volume of the observation chamber 112 may also provide a force acting to push the device 100 vertically towards the surface, as indicated by arrow 204. Additionally, the volume of the at least one buoyancy bag 188 (FIG. 10) may provide additional upward force. To counteract these forces which act to cause the device 100 to rise to the surface of the water, the volume of high density weight materials, including the lower section 106 and ballast area 196, act in the direction as indicated by arrow 208; that is, to cause the device 100 to submerge in the water. Furthermore, the volume of the propulsion mechanism 120 and the weight of the rear section 110 may also act to submerge the device 100, as indicated by arrow 206. Additional sources of weight or buoyancy may be provided as needed to make the device 100 stable and upright when submerged. Desirably, the weight components providing downward forces and buoyant components providing upward forces surround the position of the user 144 when the user is operating the device 100 such that the device 100 remains stable and upright when submerged in the water. For example, in some embodiments, including the illustrated embodiment, the lower section 106, including the oxygen tank 150, desirably is located in front of the user 144 while the rear section 110 is located behind the user 144. The weight of these components desirably is balanced by the upward buoyant forces provided by the buoyancy bag 188 and the air trapped within the observation chamber 112. In some embodiments, including the illustrated embodiment, the weight of the device 100 (excluding the weight of the oxygen tank 150) can be between about 40 lbs and 160 lbs, more desirably between about 60 lbs and about 140 lbs, and most desirably 80 lbs and 120 lbs. In some embodiments, including the illustrated embodiment, the weight of the device 100 (excluding the weight of the oxygen tank 150) can be up to about 800 lbs, more desirably up to about 600 lbs, more desirably up to about 400 lbs, more desirably up to about 300 lbs, and most desirably up to about 200 lbs.

As discussed above, in some embodiments, including the illustrated embodiment, a user 144 may vary the rate of ascent or descent of the device 100 by inflating or deflating the buoyancy bag 188 or through other means. As discussed above with respect to FIGS. 8 and 9, the pneumatic valve 178 located within the handles 130, 132 may be commanded to allow air from the oxygen tank 150 to inflate the buoyancy bag 188. Deflation of the buoyancy bag 188 may also be commanded by twisting or turning one of handles 130, 132 to open valves 180, 182 to allow air to release to the atmosphere, as described in detail above.

Safety equipment such as sensors, signals, or electronic controls may also be incorporated into device 100 in other embodiments, including the illustrated embodiment. This safety equipment may act to limit the rate of ascent or descent to set levels or may limit the maximum depth to which the device 100 may descend. In some embodiments, including the illustrated embodiment, emergency releasable weights located within the main section may be dropped manually by the user 144 or automatically. After dropping these weights, the device 100 will float to the surface of the water.

To operate the personal underwater mobility device 100, the device 100 is placed into the water and desirably the weight of the lower section 106 causes the lower section 106 to rotate into the open or standard operating position as shown in FIGS. 1-4 and 6. The device 100 can self-deploy when dropped into the water and desirably retains an upright orientation in the water with the upper section 108 the highest point of the device 100 and the unfolded lower section 106 the lowest point of the device 100. The weight of the batteries within the battery compartment 196 and the oxygen tank 150 cause the lower section 106 of the device to deploy or rotate into an unfolded configuration while the buoyancy provided by the deployable buoy 140 and the air retained or trapped within the observation chamber 112 counteract the weight of the components housed within the lower section 106 to keep the device 100 vertically upright, neutrally buoyant, and stable in the water. Thus, when deployed in the water, the device 100 falls straight into the water with the lower section 106 naturally opening to be deeper in the water than the upper section 108 and the observation chamber 112. The location of the buoyancy provided by the observation chamber 112, buoy 140, and the one or more buoyancy bags 188 counteract the weight of the lower section 106 and the rear section 110 such that the device 100 desirably maintains an upright position in the water while the device unfolds and when in a fully unfolded or open configuration.

Rotation of the lower section 106 to the open or standard operating position also secures the oxygen tank 150 within the oxygen compartment 156. To enter the observation chamber 112, the user 144 may dive underneath the device 100 and enter the observation chamber 112 from behind the device 100. The user 144 may also enter the observation chamber 112 from either side of the device 100. The user 144 inserts at least his or her head and shoulders into the observation chamber 112 such that his or her head displaces some of the air trapped within the observation chamber 112. The lower portion of the user's body, desirably from the chest down, is outside the device 100. Desirably, when in an unfolded configuration, the device 100 defines a space 300 (FIG. 1A) for the user's chest and lower body. Desirably, at least the user's head and more desirably also a portion of the user's shoulders are within the observation chamber 112. The hips and buttocks of the user 144 are desirably surrounded by the steering surface defined by the rear section 110. The device 100, when unfolded, desirably defines an open space 300 for user's lower body including the hips and buttocks such that the user's hips are below and behind the observation chamber 112 when the user 144 is operating the device 100. Additionally, the space 300 further allows the user's feet to be positioned below and behind the user's hips when the user 144 is operating the device 100. Desirably, the device 100 does not have a seat or other support for the front of the user's hips, legs, or buttocks.

Due to the buoyancy of the device 100, the user 144 is being carried by the device 100, rather than supporting the weight of the device 100 on his or her shoulders. The user can reach his or her arms forward to grasp the user graspable handles 130, 132. Desirably, this movement places the user 144 in a generally upright and forward position with his or her legs trailing down and behind him or her. Desirably, the user 144 is inclined no more than about 35 degrees forward from a vertical axis passing through the center of gravity of the device 100 (the vertical axis is indicated by arrow 204 of FIG. 14), more desirably no more than about 30 degrees forward from a vertical axis passing through the center of gravity of the device 100, and most desirably no more than about 25 degrees forward from a vertical axis passing through the center of gravity of the device 100. In some embodiments, including the illustrated embodiment, the user 144 is inclined between about 10 degrees and about 60 degrees forward from a vertical axis passing through the center of gravity of the device 100 or between about 20 degrees and about 50 degrees forward from a vertical axis passing through the center of gravity of the device 100. Preferably, the user's hips are aligned with the right contact surface 115 and the left contact surface 117 of the rear section 110. As discussed above, the right contact surface 115 and the left contact surface 117 may be interchangeable and customizable to allow user's with different body shapes or morphologies to comfortably use and control the device 100. In some embodiments, including the illustrated embodiment, the device 100 is steerable by the lower body of the user 144 due to pressure on the steering surface of the rear section 110 by the user's hips or lower body. Desirably, the rear section 110 will twist as the user 144 twists his or her lower body to steer the device 100 in the desired direction of travel.

Preferably, the user 144 can control the speed of the device 100 by manipulating one of handles 130, 132 as discussed above. In some embodiments, including the illustrated embodiment, the user 144 can also use his feet to help maneuver, steer, and/or propel the underwater personal mobility device 100. The device 100 can be configured to allow power to the motor to be cut if the power level of the device 100 drops to a certain level with a low power or other warning signal also provided to the user 144. Whether or not the motor is powered, the user 144 inside the observation chamber 112 desirably can still propel and/or maneuver the device 100 with his or her feet, especially if he or she is wearing flippers. However, in other embodiments, including the illustrated embodiment, other steering components such as flaps or other control surfaces on the rear section 110 or lower section 106 may be used to steer the device 100.

In some embodiments, including the illustrated embodiment, the submersible device 100 can travel between the surface and a depth of approximately 75 feet, more desirably between the surface and a depth of approximately 100 feet, or most desirably between the surface and a depth of approximately 45 meters or approximately 150 feet. In some embodiments, including the illustrated embodiment, the submersible device 100 can desirably operate at a depth of at least 75 feet, more desirably at a depth of at least 100 feet, or most desirably at a depth of at least 150 feet or approximately 45 meters. In some embodiments, including the illustrated embodiment, the submersible device 100 can desirably operate at a depth of no more than approximately 300 feet, more desirably at a depth of no more than approximately 250 feet, even more desirably at a depth of no more than approximately 200 feet, or most desirably at a depth of no more than approximately 150 feet. In some embodiments, including the illustrated embodiment, the submersible device 100 can desirably operate at a depth of no more than 300 feet, more desirably at a depth of no more than 250 feet, even more desirably at a depth of no more than 200 feet, or most desirably at a depth of no more than 150 feet while the submersible device 100 remains neutrally buoyant. In some embodiments, including the illustrated embodiment, the submersible device 100 can reach speeds of between 2 and 10 knots, more desirably between 3 and 8 knots, and most preferably between 4 and 6 knots. In some embodiments, including the illustrated embodiment, the submersible device 100 can desirably reach a speed of at least 2 knots, more desirably a speed of at least 4 knots, more desirably a speed of at least 6 knots, even more desirably a speed of at least 8 knots, and most desirably a speed of at least 10 knots.

In an alternative embodiment, scanner and acquisition sensors can be provided on the device 100. For example, in some embodiments, including the illustrated embodiment, the device 100 can be equipped with at least one scanner and/or at least one sensor. The scanner and acquisition sensor may be located on the upper section 108. During use, therefore, in addition to allowing a user 144 to discover a reef or other underwater feature, in some embodiments, including the illustrated embodiment, the device 100 can also gather data about the ocean and ocean life, including for example, water quality, the temperature of the currents, the density of plankton and bacteria, the acidity of the water, or the status of photosynthesis in the coral reef. Without any effort or particular focus, the user 144 can gather information which can then be stored or directly transferred to a common server via the internet and become accessible by researchers around the world. The scanner can define and record a 3D map of the underwater feature and its movement in deep and shallow water. In accordance with some embodiments, including the illustrated embodiment, scanned and acquired information can be transferred either automatically or manually to provide an updated 3D map of the bottom of the sea, as well as conditions of the ocean and ocean life. Other various sensors can be incorporated into the unit as desired. It is contemplated that an open source for oceanic data may become crucial and in demand by marine biologists around the world.

Although this application discloses certain preferred embodiments and examples, it will be understood by those skilled in the art that the present inventions extend beyond the specifically disclosed embodiments to other alternative embodiments and/or uses of the invention and obvious modifications and equivalents thereof. Further, the various features of these inventions can be used alone or in combination with other features of these inventions other than as expressly described above. While the disclosed embodiments are primarily directed to an underwater personal mobility device, aspects of the invention may be used in connection with other types of submersible devices. Thus, it is intended that the scope of the present inventions herein disclosed should not be limited by the particular disclosed embodiments described above, but should be determined only by a fair reading of the claims that follow.

What is claimed is:

1. An underwater personal mobility apparatus, comprising:

a main body comprising a main section and a folding section further comprising a mount for an oxygen tank; and a rear section that is rotatable with respect to the main section, the rear section further comprising a propulsion mechanism and at least a portion defining a steering surface configured to contact at least a portion of a user's lower body such that the user can steer the underwater personal mobility apparatus by turning the user's body to engage the steering surface;

wherein the folding section is rotatable with respect to the main section such that the apparatus may be folded to a folded configuration to facilitate transportation of the apparatus and may be unfolded when submerged to an unfolded configuration.

2. The underwater personal mobility apparatus of claim 1, wherein the propulsion mechanism is supported by the main section.

3. The underwater personal mobility apparatus of claim 1, wherein the propulsion mechanism may be operatively connected to one of the main section and a rear section coupled to the main section.

4. The underwater personal mobility apparatus of claim 3, wherein the propulsion mechanism further comprises an electrically powered motor, a thruster driven by the motor, and at least one battery connected to the motor.

5. The underwater personal mobility apparatus of claim 1, wherein the mount defines a cylindrical surface for at least partially supporting an oxygen tank.

6. The underwater personal mobility apparatus of claim 1, wherein the folding section is rotatably connected to the main section via a mechanical linkage.

7. The underwater personal mobility apparatus of claim 6, wherein the folding section rotates about a linkage axis defined by the mechanical linkage.

8. The underwater personal mobility apparatus of claim 7, wherein the main section further comprises a buoyancy chamber.

9. The underwater personal mobility apparatus of claim 8, wherein the buoyancy chamber is located above the linkage axis.

10. The underwater personal mobility apparatus of claim 9, wherein the buoyancy chamber is located such that the buoyancy chamber is above the folding section when the apparatus is in an unfolded configuration.

11. The underwater personal mobility apparatus of claim 9 further comprising a deployable buoy that can deploy from the main section.

12. The underwater personal mobility apparatus of claim 11, wherein the buoyancy chamber, deployable buoy, propulsion mechanism, and oxygen tank storage space are located around the user when the user's head is within the observation chamber that the underwater apparatus may achieve neutral buoyancy and vertical stability at a predetermined depth.

13. The underwater personal mobility apparatus of claim 1, wherein the folding section further comprises an oxygen tank storage space configured to receive an oxygen tank such that the oxygen tank cannot be removed from the oxygen tank storage space when the apparatus is in an unfolded configuration and the oxygen tank may be removed from or placed within the oxygen tank storage space when the apparatus is in a folded configuration.

14. The underwater personal mobility apparatus of claim 1, wherein the apparatus is steerable with a lower portion of a body of a user.

15. The underwater personal mobility apparatus of claim 1 further comprising an observation chamber for retaining at least a head of a user.

16. The underwater personal mobility apparatus of claim 15, wherein the mount is positioned such that a center of gravity of an oxygen tank is secured by the mount in front of the observation chamber when the apparatus is in an unfolded configuration.

17. The underwater personal mobility apparatus of claim 15, wherein the observation chamber comprises part of the main section.

18. The underwater personal mobility apparatus of claim 17 further comprising hand controls located forward and below the observation chamber.

19. The underwater personal mobility apparatus of claim 15 configured to define an open space for the user's hips and buttocks configured such that the user's hips and buttocks are located below and behind the observation chamber when the user's head is within the observation chamber.

20. The underwater personal mobility apparatus of claim 19, wherein the open space is configured such that a user's legs and feet may extend below and behind the user's hips and buttocks.

21. The underwater personal mobility apparatus of claim 1 further comprising at least one wheel such that when the underwater personal mobility apparatus is in a folded configuration and the wheel is on a rolling surface, a center of gravity of an oxygen tank is forward of the wheel to make the underwater personal mobility apparatus easy to rotate about the wheel.

22. An underwater personal mobility apparatus, comprising:

a main body comprising a main section, a folding section, and a rear section, the main section supporting at least one buoyancy member and an observation chamber, the observation chamber configured to accommodate at least a user's head, the folding section configured to hold an oxygen tank, the folding section rotatable with respect to the main section such that the apparatus may fold for ease of use, the rear section comprising a propulsion mechanism, the rear section rotatable with respect to the main section and configured to contact the user's body such that a user's hips can rotate the rear section to steer the underwater personal mobility apparatus.

23. The apparatus of claim 22 further comprising at least one wheel located on a lower portion of the folding section such that a center of gravity of the oxygen tank is located forward of the at least one wheel when the apparatus is in a folded configuration.

24. An underwater personal mobility apparatus, comprising:

a main body comprising a main section and a folding section, the main section comprising a buoyancy chamber;

wherein the folding section is rotatably connected to the main section via a mechanical linkage defining a linkage axis such that the apparatus may be folded to a folded configuration to facilitate transportation of the apparatus and may be unfolded when submerged to an unfolded configuration, the buoyancy chamber is located above the linkage axis such that the buoyancy chamber is above the folding section when the apparatus is in an unfolded configuration, said underwater personal mobility apparatus further comprising a propulsion mechanism and said underwater personal mobility apparatus is steerable with a lower portion of a body of a user.

25. An underwater personal mobility apparatus, comprising:

a main body comprising a main section and a folding section further comprising a mount for an oxygen tank;

wherein the folding section is rotatable with respect to the main section such that the apparatus may be folded to a folded configuration to facilitate transportation of the apparatus and may be unfolded when submerged to an unfolded configuration, the mount configured to receive an oxygen tank such that the oxygen tank cannot be removed from the mount when the apparatus is in an unfolded configuration and the oxygen tank may be removed from or connected to the mount when the apparatus is in a folded configuration, said underwater personal mobility apparatus further comprising a propulsion mechanism and said underwater personal mobility apparatus is steerable with a lower portion of a body of a user.

* * * * *